US008800815B1

(12) United States Patent
Butler et al.

(10) Patent No.: US 8,800,815 B1
(45) Date of Patent: Aug. 12, 2014

(54) CONTAINER FOR USE WITH A COUNTER MOUNTED DISPENSING SYSTEM

(71) Applicant: Pibed Limited, Denby (GB)

(72) Inventors: Robert Butler, Nottingham (GB); Laura Anne Hay, Banchory (GB); Efthimia Ioannou, Paphos (CY); Adela Walczak, Lodz (PL); Stewart Banks, Alfanzina Near Carvoiro (PT); Christopher James Lang, Nottingham (GB); Dean Philip Limbert, Derby (GB)

(73) Assignee: Pibed Limited, Denby, Derbyshire (GB)

( * ) Notice: Subject to any disclaimer, the term of this patent is extended or adjusted under 35 U.S.C. 154(b) by 0 days.

(21) Appl. No.: 13/803,952

(22) Filed: Mar. 14, 2013

Related U.S. Application Data

(60) Provisional application No. 61/768,918, filed on Feb. 25, 2013.

(51) Int. Cl.
*B65D 88/54* (2006.01)

(52) U.S. Cl.
USPC ..... 222/105; 222/1; 222/94; 222/173; 222/386.5; 141/114; 383/906; 383/907

(58) Field of Classification Search
USPC ..... 222/94, 95, 105, 386.5, 1, 173; 141/114; 383/38, 906, 907
See application file for complete search history.

(56) References Cited

U.S. PATENT DOCUMENTS 3,651,990 A * 3/1972 Cernei ..... 222/94
3,911,918 A * 10/1975 Turner ..... 604/410
4,875,508 A 10/1989 Burke, II et al.
5,069,359 A * 12/1991 Liebel ..... 229/117.3
5,632,414 A 5/1997 Merriweather, Jr.
5,927,551 A * 7/1999 Taylor et al. ..... 222/95
6,142,342 A 11/2000 Lewis
6,170,715 B1 1/2001 Evans
6,402,021 B1 * 6/2002 Heathcock ..... 229/242

(Continued)

FOREIGN PATENT DOCUMENTS

CA 2427065 A1 12/2003
EP 2070460 A2 6/2009

(Continued)

OTHER PUBLICATIONS

Bobrick Technical Data. "Lavatory-Mounted Soap Dispenser B-822". Bobrick Washroom Equipment, Inc.: Revised Apr. 27, 2011.

(Continued)

*Primary Examiner* — J. Casimer Jacyna
(74) *Attorney, Agent, or Firm* — Hill & Schumacher

(57) ABSTRACT

The present disclosure relates to a container for flowable material configured to be installed in a counter below an access hole. The container includes a first deformable portion and a second deformable portion. The first deformable portion defines a first cavity and has a sealable first cavity inlet. The second deformable portion defines a second cavity and is in flow communication with the first cavity. The first deformable portion is configured to deform to fit into the access hole when substantially no flowable material is therein and the second deformable portion configured to deform to fit through the access hole when substantially no flowable material is therein. The disclosure also includes a method of installing a container of flowable material in a counter below an access hole.

29 Claims, 28 Drawing Sheets

(56) References Cited

U.S. PATENT DOCUMENTS

| | | | | |
|---|---|---|---|---|
| 7,395,842 | B2 | 7/2008 | Dyer | |
| 8,100,299 | B2 | 1/2012 | Phelps et al. | |
| 8,371,474 | B2 | 2/2013 | Tramontina et al. | |
| 2003/0168471 | A1 | 9/2003 | Redman et al. | |
| 2003/0205584 | A1 | 11/2003 | Niggemyer | |
| 2004/0094574 | A1 | 5/2004 | Sallows et al. | |
| 2007/0084521 | A1 | 4/2007 | Rhodenbaugh et al. | |
| 2008/0121660 | A1 | 5/2008 | Ophardt | |
| 2008/0302823 | A1 | 12/2008 | Young | |
| 2009/0084813 | A1 | 4/2009 | Chen | |
| 2010/0264165 | A1* | 10/2010 | Hansen et al. | 222/95 |
| 2011/0000266 | A1 | 1/2011 | Righetto | |
| 2011/0024447 | A1 | 2/2011 | Ciavarella et al. | |
| 2011/0062185 | A1* | 3/2011 | McFarland | 222/105 |
| 2011/0192865 | A1* | 8/2011 | Jung | 222/95 |
| 2011/0215115 | A1 | 9/2011 | Proper | |
| 2012/0104035 | A1* | 5/2012 | Bates et al. | 222/1 |

FOREIGN PATENT DOCUMENTS

| | | | |
|---|---|---|---|
| GB | 2333129 | A | 7/1999 |
| WO | 2005107680 | A1 | 11/2005 |
| WO | 2010121800 | A1 | 10/2010 |
| WO | 2011056747 | A1 | 5/2011 |

OTHER PUBLICATIONS

Bobrick Technical Data. "Automatic Lavatory-mounted Soap Dispenser B-826 & B-826.18". Bobrick Washroom Equipment, Inc.: Revised May 2006.

Bobrick Technical Data. "Lavatory-Mounted Soap Dispenser with Under-the-Counter Soap Reservoir B-922 & B-9226". Bobrick Washroom Equipment, Inc.: Revised May 2006 Series D.

Bobrick Technical Data. "Lavatory-Mounted Soap Dispenser B-8221". Bobrick Washroom Equipment, Inc.: Revised Apr. 27, 2011.

Bobrick Technical Data. "Lavatory-Mounted Soap Dispenser B-8226". Bobrick Washroom Equipment, Inc.: Revised Apr. 27, 2011.

Bobrick Technical Data. "Lavatory-Mounted Soap Dispenser B-82216". Bobrick Washroom Equipment, Inc.: Revised Apr. 27, 2011.

Dolphin Dispensers. "Counter Mounted Soap Dispensers: Model Nos. DP800, DP801, DP802, DP803, DP804, DP805, DP806, DP807, WP190, WP190-1, WP191-1, WP191-3, WP193, WP195". Bell-Chem Products Company. <http://www.dolphindispensers.co.uk/ranges/counter-mounted-soap-dispensers/22.htm>.

Rubbermaid Commercial Products. "FG401310 One Shot Liquid Dispenser—Polished Chrome/Black". Accessed Jul. 13, 2013. <http://www.rubbermaidcommercial.com/rcp/products/detail.jsp?rcpNum=FG401310>.

Rubbermaid Commercial Products. "FG401544 Manual Liquid Dispenser—Polished Chrome". Accessed Jul. 13, 2013. <http://www.rubbermaidcommercial.com/rcp/products/detail.jsp?rcpNum=FG401544>.

International Search Report and Opinion for related international application PCT/CA2014/050128 filed Feb. 24, 2014, the search report and opinion mailed Jun. 17, 2014 and opinion of Jun. 12, 2014.

* cited by examiner

CONTAINER FOR USE WITH A COUNTER MOUNTED DISPENSING SYSTEM

FIELD OF THE DISCLOSURE

This disclosure relates to liquid dispensing systems and in particular containers for use with a counter mounted dispensing system.

BACKGROUND

Counter mounted soap and foam dispensers are becoming commonplace in modern away from home washroom environments. In fact many of the washroom counters produced are supplied complete with a predrilled 1" diameter hole in close proximity to washbasin to allow for the easy installation of such systems. These dispensers are available as both manual pump activated and automatic sensor activated devices, with the dispensing head being installed in counter from above, and the cartridge of product installed below the counter. Systems are available that use both hygienically sealed collapsible cartridges as well as open refillable reservoirs. There are several reasons why a counter mounted system is preferable to a wall mounted system, examples being: a lack of wall space; maintaining the washroom aesthetic; and personal preference.

SUMMARY

The present disclosure relates to a container for flowable material configured to be installed in a counter below an access hole. The container includes a first deformable portion and a second deformable portion. The first deformable portion defines a first cavity and has a sealable first cavity inlet. The second deformable portion defines a second cavity and is in flow communication with the first cavity. The first deformable portion is configured to deform to fit into the access hole when substantially no flowable material is therein and the second deformable portion configured to deform to fit through the access hole when substantially no flowable material is therein.

The container may include a neck portion between the first deformable portion and the second deformable portion.

The container may include a removable clip configured to engage the neck portion and to inhibit flow from the first cavity to the second cavity when engaged on the neck portion.

The sealable first cavity inlet may be sealed with a pump. The pump may include a dip tube. The pump may be configured to be engaged by a dispenser.

The first deformable portion may have a liquid therein and further may include a seal affixed to the sealable first cavity inlet.

The pump may have a dip tube and the pump is connectable to the sealable first cavity inlet whereby the dip tube extends through the first deformable portion into the second deformable portion.

The seal may be removable prior to connecting the pump.

The dip tube may be insertable through the seal.

The first deformable portion may be detachable from the second deformable portion.

The first deformable portion may include a first neck portion and the second deformable portion may include a second neck portion and the first neck portion and the second neck portion may be releasably connectable together. The first neck portion and the second neck portion may be connected with a detachable neck joint wherein the neck joint is a perforated neck joint or a press fit neck joint. Alternatively the first neck portion and the second neck portion may be connected with a screw fit neck joint.

The container may further include a box for transporting the container. The box may include a removable portion.

The second deformable portion may be wound into a tube. The tube may be folded so that the tube rests against the first deformable portion.

The first deformable portion and the second deformable portion are resiliently deformable.

The first deformable portion and the second deformable portion may be manufactured from one of BOPP (biaxially oriented polypropylene), BON (biaxially oriented nylon), CA (cellulose acetate), CTFE (chlorotrifluoroethylene), EAA (ethylene acrylic acid), EEA (ethylene-ethyl acrylate), EMA (ethylene-methyl acrylate), EVA (ethylene-vinyl acetate), EVOH (ethylene-vinyl alcohol), HIPS (high impact polystyrene), LDPE (low-density polyethylene), LLDPE (linear low-density polyethylene), mPE (metallocene polyethylene) OPP (oriented polypropylene), PA (polyamide), PAN (polyacrylonitrile), PB (polybutylene), PE (polyethylene), PET (poly (ethylene terephthalate)), PETG (poly(ethylene terephthalate) glycol), PLA (poly(lactic acid)), PP (polypropylene), PS (polystyrene), PTFE (polytetrafluoroethylene), PUR (polyurethane), PVC (poly(vinyl chloride)), and PVDC (poly(vinylidene chloride)). or from one of latex, silicone rubber, polyisoprene and mylar.

A cage may be attached to the counter below the access hole. The cage may include a lower portion removably attached to an upper portion.

The disclosure includes a method of installing a container of flowable material in a counter below an access hole, the container having a first deformable portion in flow communication with a second deformable portion, the method comprising the steps of:

feeding the second deformable portion having substantially no flowable material therein through the access hole;

urging the flowable material in the first deformable portion into the second deformable portion;

feeding the first deformable portion having substantially no flowable material therein into the access hole; and positioning a pump in the access hole whereby the pump is in flow communication with the container.

The pump may be attached to the first deformable portion prior to the first feeding step.

The method may include the step of attaching a dispenser to the pump.

The first deformable portion may have a first cavity inlet and a seal attached thereto and the method may include the step of removing the seal and then performing the step of positioning a pump.

The first deformable portion may have a first cavity inlet and a seal attached thereto and method may include the step of piercing the seal with the pump and then performing the step of positioning a pump.

The container may further include a box and the box includes a removable portion, and the method may include the steps of removing the removable portion of the box; removing the first deformable portion from the box; squeezing the box to urge the flowable material in the first deformable portion into the second deformable portion; and removing the box.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
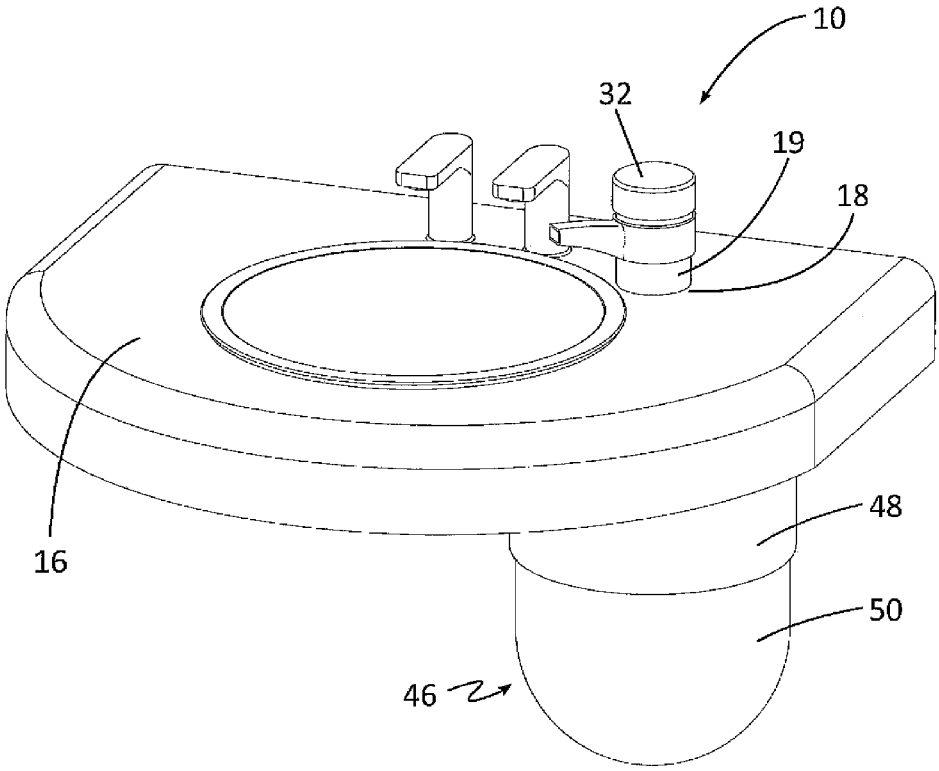
FIG. 1 is a perspective view of a dispensing system having a liquid container located underneath a counter.
Figure 3:
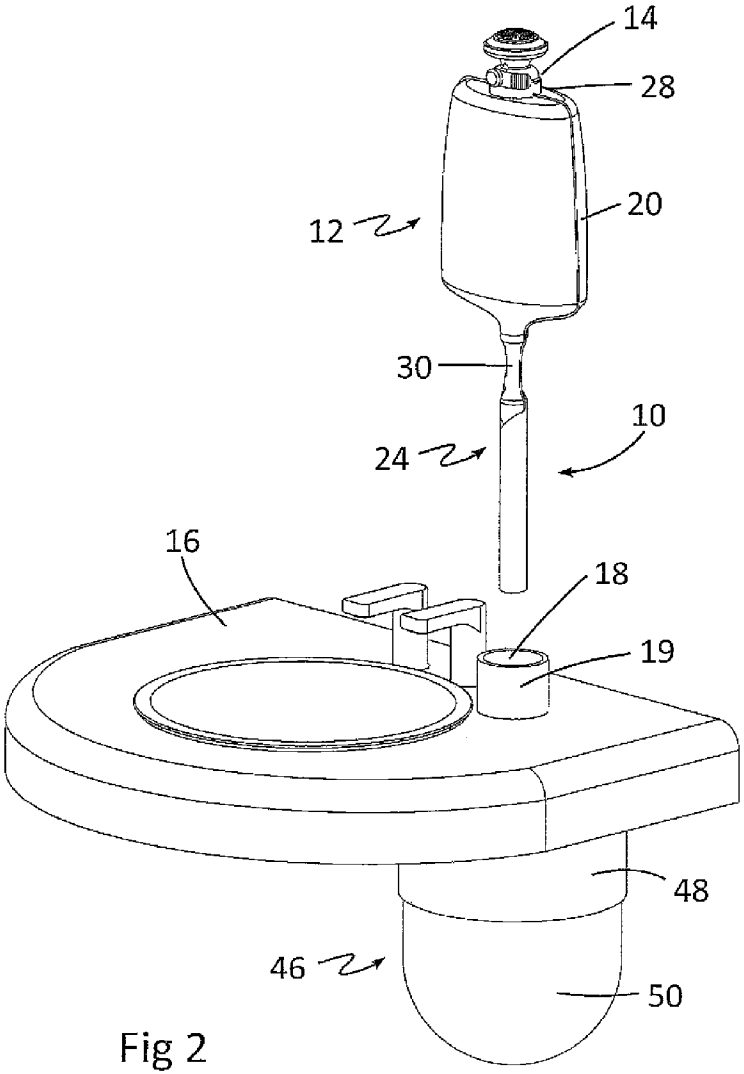
FIG. 3 is a perspective view of the container of FIG. 2 with a second deformable portion of the container through the aperture formed in the counter and a first deformable portion of the container above the counter.

Referring to FIGS. 1 to 11, a counter mounted dispensing system is shown generally at 10. The counter mounted dispensing system 10 includes a deformable container 12 and a pump 14. Dispensing system 10 is adapted to be positioned in a counter 16 through an access hole 18. The access hole 18 may have a mount 19 extending upwardly from the hole. The deformable container 12 is for use in association with a liquid or other flowable material, typically hand cleaner or foamable hand cleaner.

Figure 2:
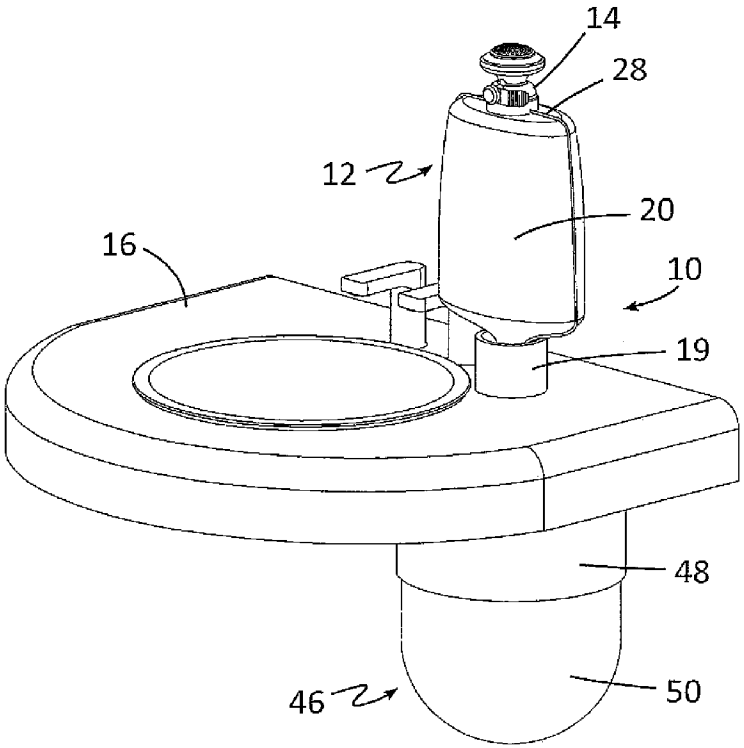
FIG. 2 is a perspective view of a container just prior to being mounted through an aperture formed in a counter.
Figure 4:
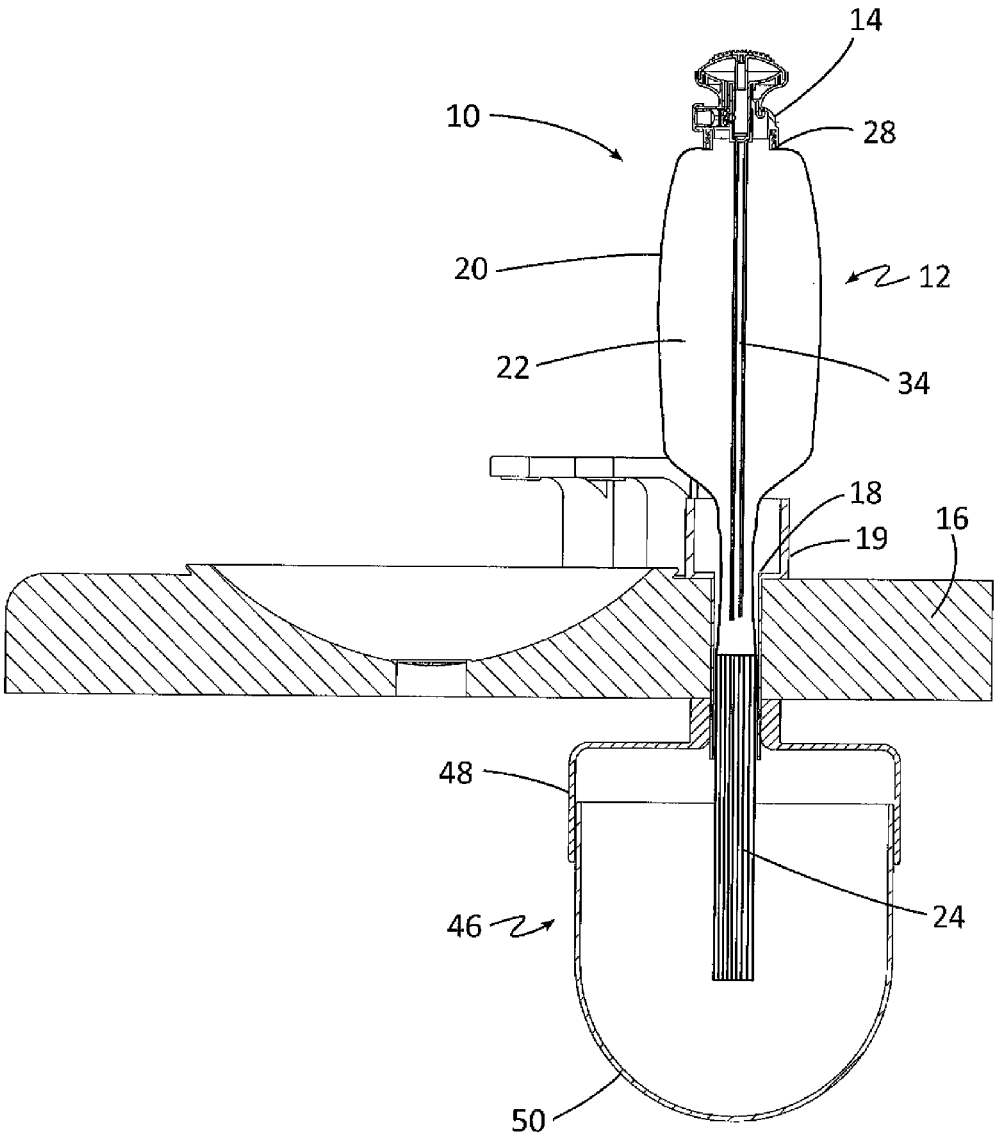
FIG. 4 is a sectional view of FIG. 3 showing the container of FIGS. 2 and 3 with a second deformable portion of the container through the aperture formed in the counter and a first deformable portion of the container above the counter.
Figure 5:
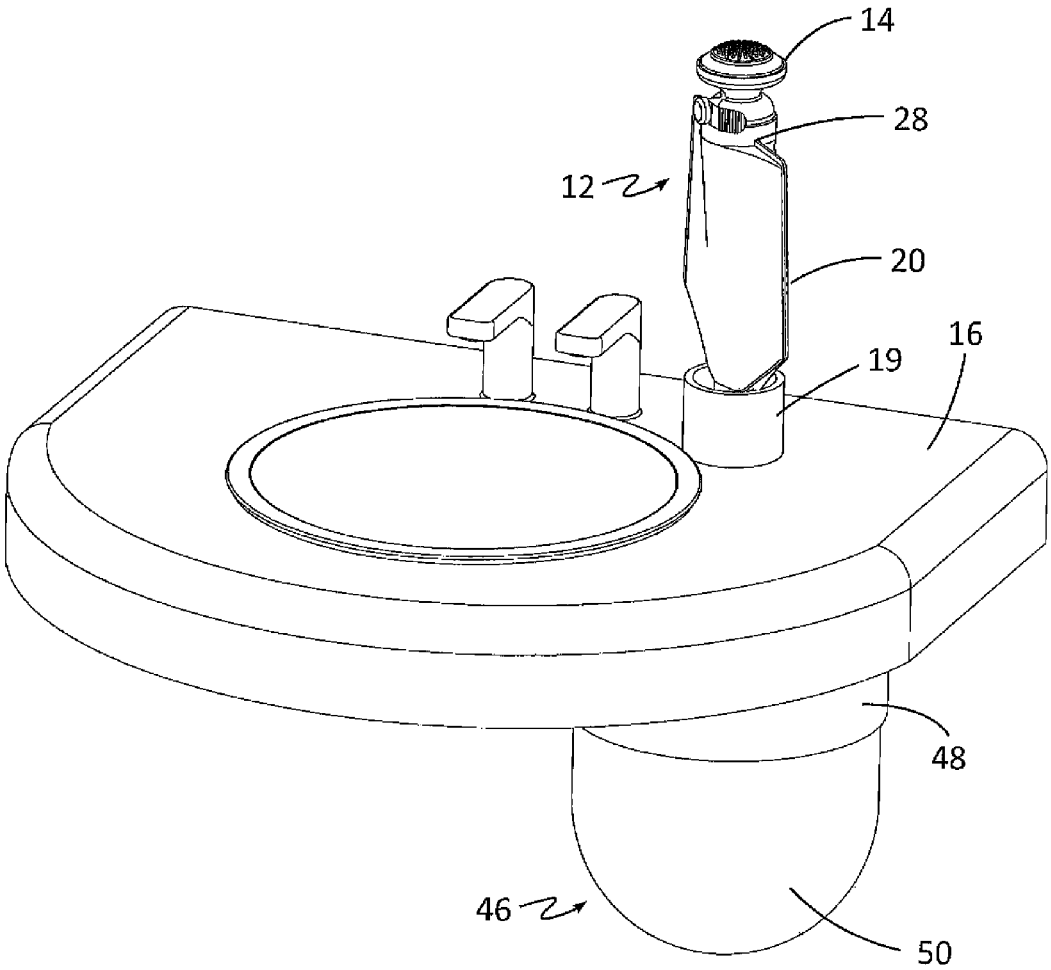
FIG. 5 is a perspective view of the container similar to that shown in FIG. 3 but showing a portion of the liquid having been transferred from the first deformable portion and into the second deformable portion.
Figure 6:
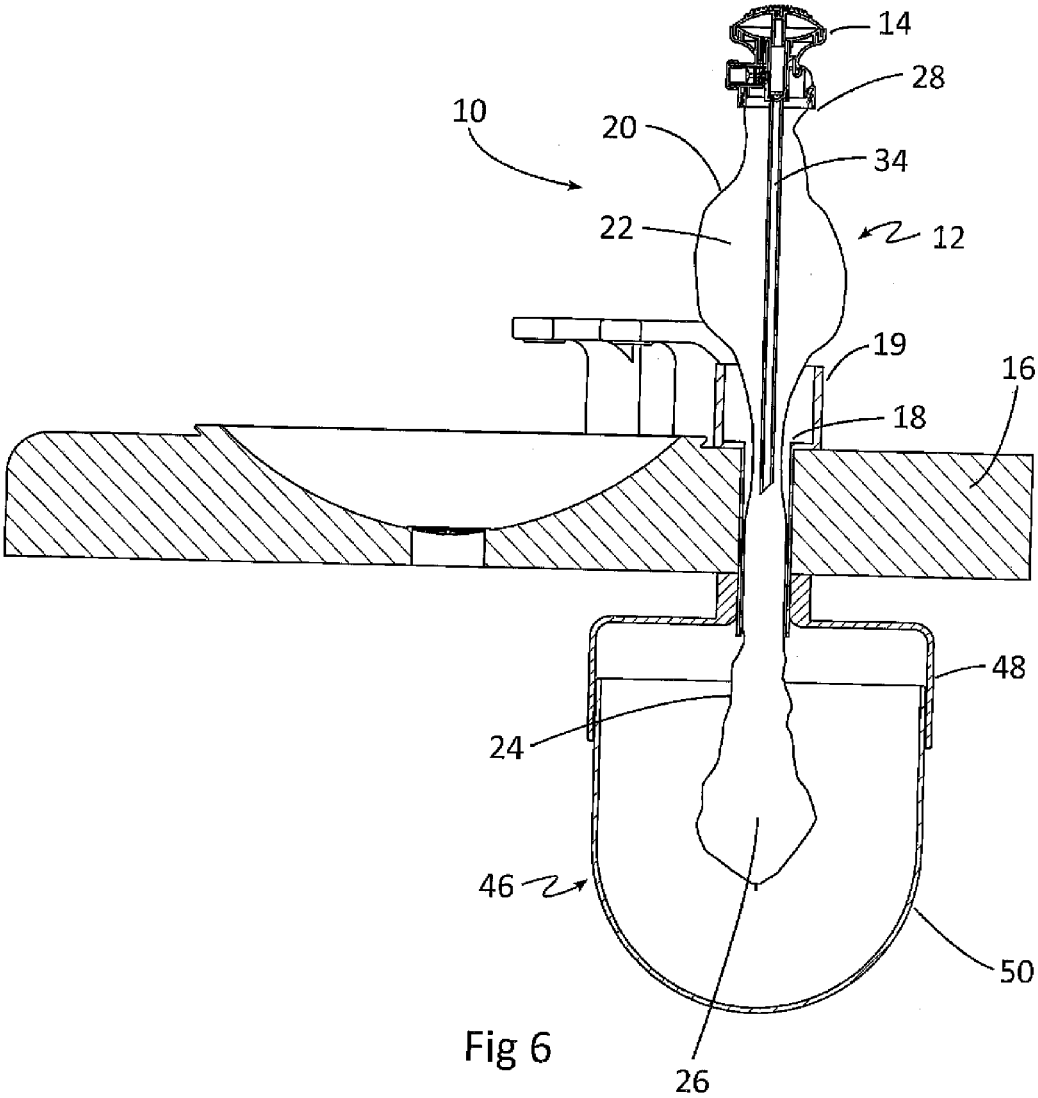
FIG. 6 is a sectional view of the container of FIG. 5.
Figure 7:
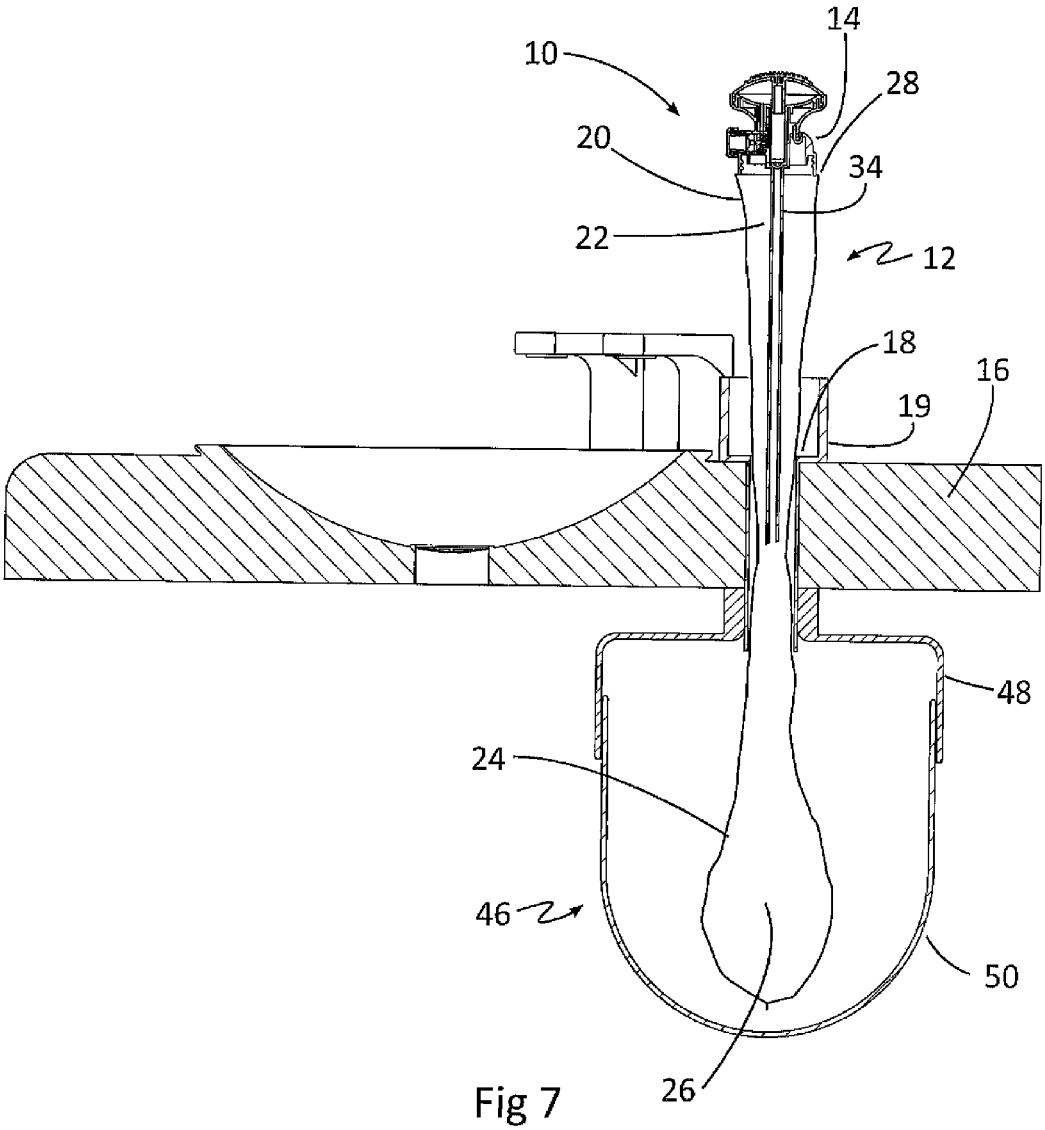
FIG. 7 is a sectional view of the container similar to that shown in FIG. 5 but showing more of the liquid having been transferred into the second deformable portion.
Figure 8:
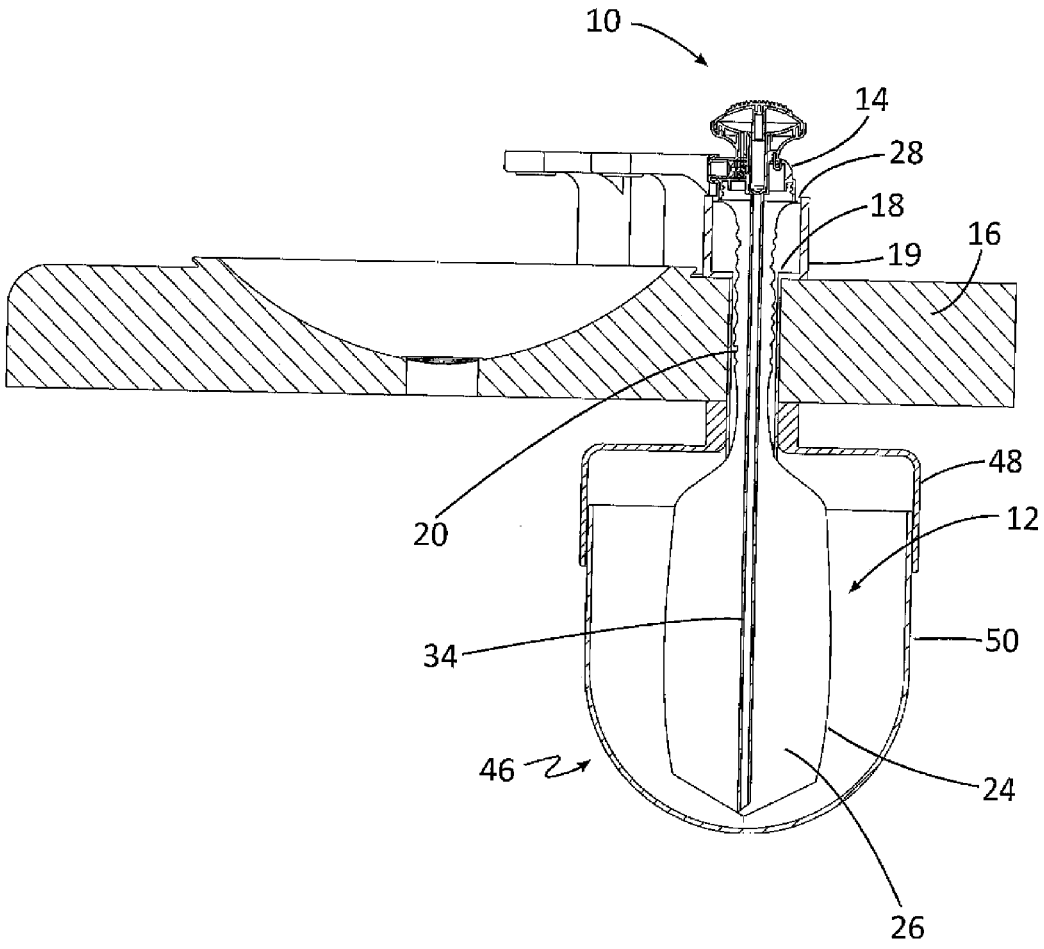
FIG. 8 is a sectional view of the container similar to that shown in FIGS. 6 and 7 but showing the liquid having been transferred into the second deformable portion and showing the pump installed in the aperture formed in the counter.
Figure 9:
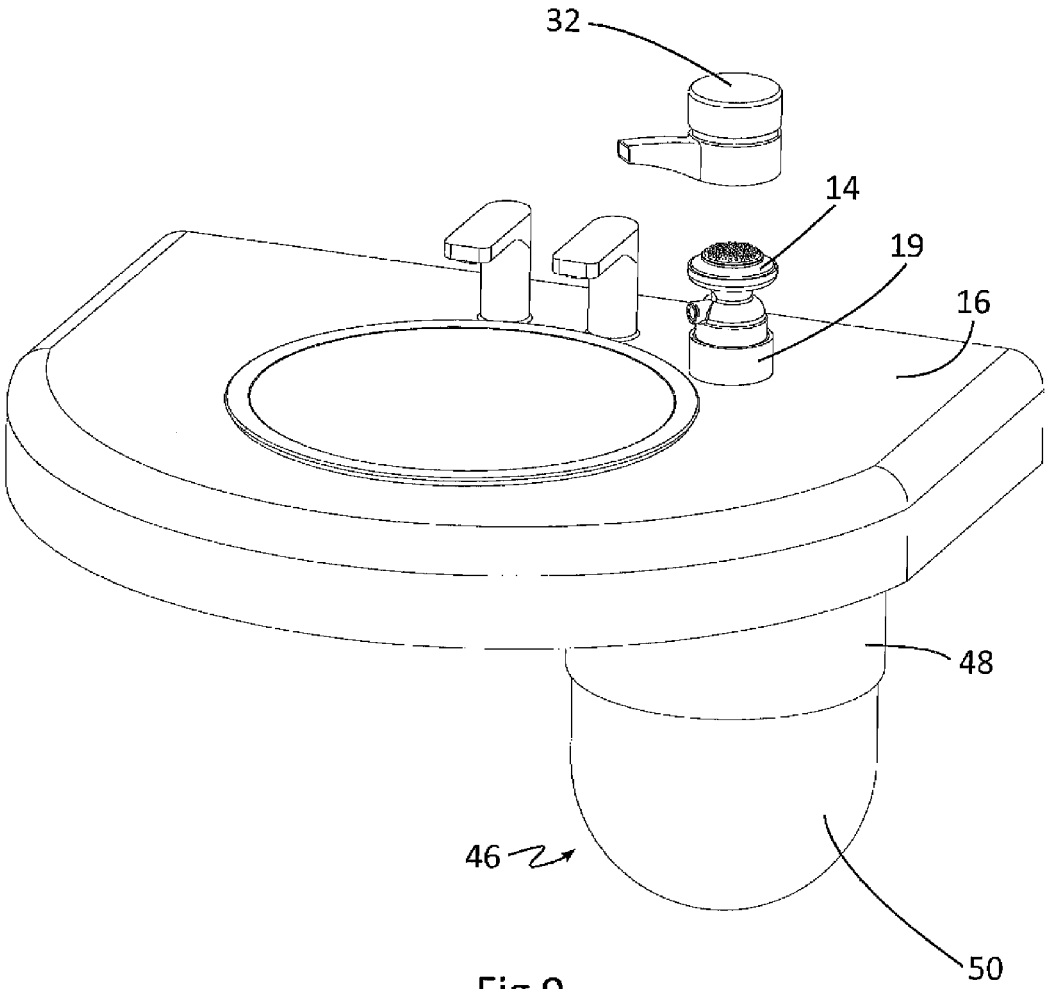
FIG. 9 is a perspective view of the container of FIGS. 2 to 8 installed in the aperture formed in the counter and further showing an optional dispenser being positioned over the pump.

The deformable container 12 includes a first deformable portion 20 which defines a first cavity 22 and a second deformable portion 24 which defines a second cavity 26. The second cavity 26 is in flow communication with the first cavity 22 through a neck portion 30. The first cavity 22 has a first cavity inlet 28. The second deformable portion 24 is configured to deform to fit through the access hole 18 when substantially no flowable material is therein. The second deformable portion 24 may be wound into a tube as shown in FIG. 2. It may be wound into a tube during the manufacturing process prior to shipping and the tube configuration facilitates feeding the second deformable container 24 through the access hole 18. Similarly, the first deformable portion 20 is configured to deform to fit through the access hole 18 when substantially no flowable material is therein. Second deformable portion 24 will unwind from the tube configuration as flowable material moves form the first deformable portion 20 into the second deformable portion 24.

Optionally the first cavity inlet 28 is sealable first cavity inlet and is sealed with a pump 14. Pump 14 may be any standard type of pump. An example of the pump used herein is shown in U.S. application Ser. No. 13/458,318, filed Apr. 27, 2012. An alternate example of a pump 15 is shown in FIGS. 10 to 14. It will be appreciated by those skilled in the art that a wide variety of pumps may be used with deformable container 12. The pump has a dip tube 34 that extends from the first cavity 22 into the second cavity 26 when the dispensing system 10 is positioned in the counter 16. Optionally the pump 14 is adapted to be attached to or engaged by a dispenser 32. Alternate pump 15 may also be adapted to engage a dispenser 33. The dispenser may be attachable to the counter 16.

Figure 17:
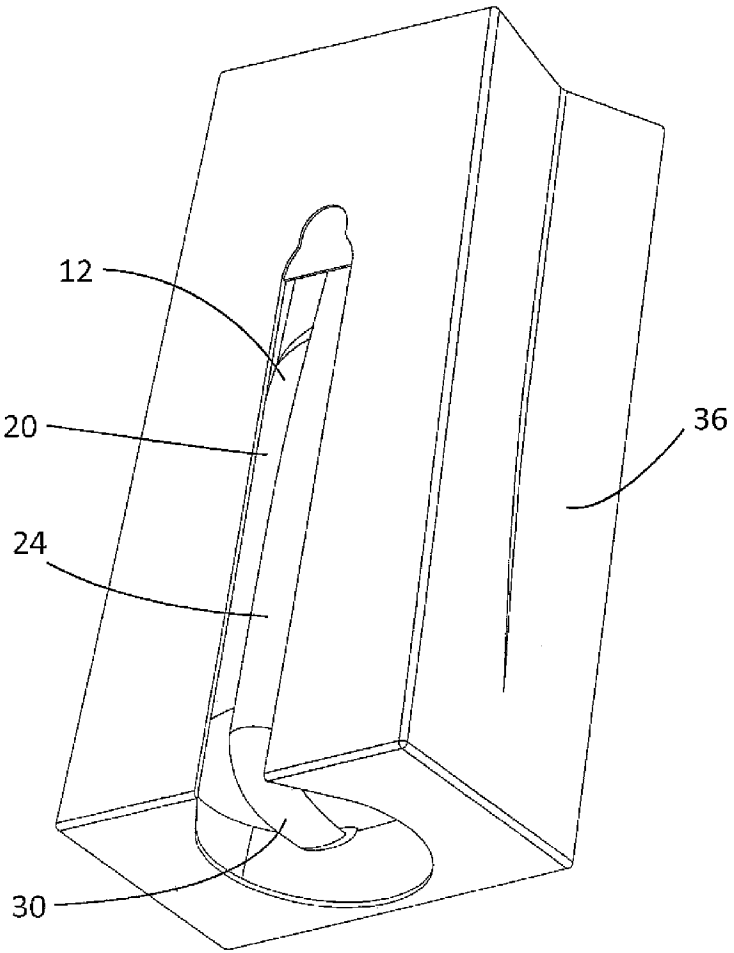
FIG. 17 is a perspective view of the shipping container of FIGS. 15 and 16 showing the removable portion removed.
Figure 20:
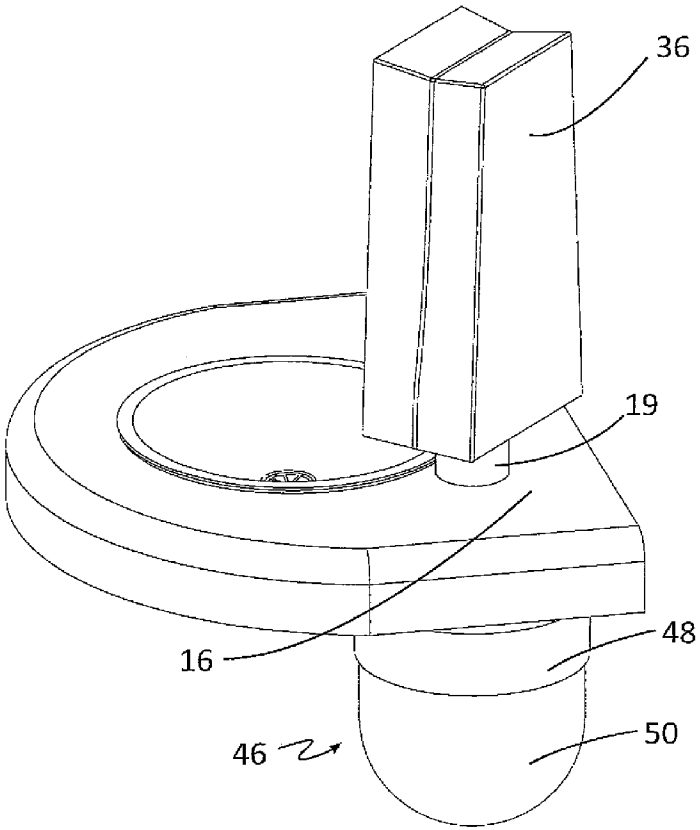
FIG. 20 is a perspective view similar to that shown in FIG. 19 but showing the second cavity inserted into the aperture in the counter.
Figure 19:
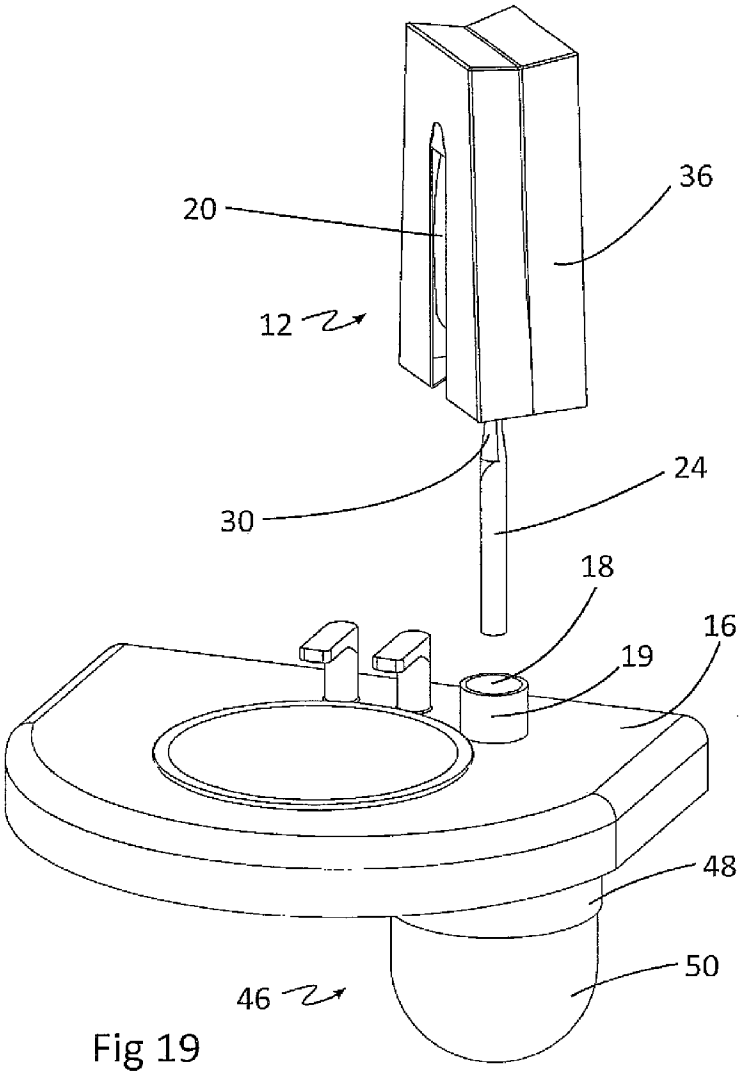
FIG. 19 is a perspective view similar to that shown in FIG. 18 but showing the second deformable portion on the verge of being inserted into the aperture in the counter.
Figure 21:
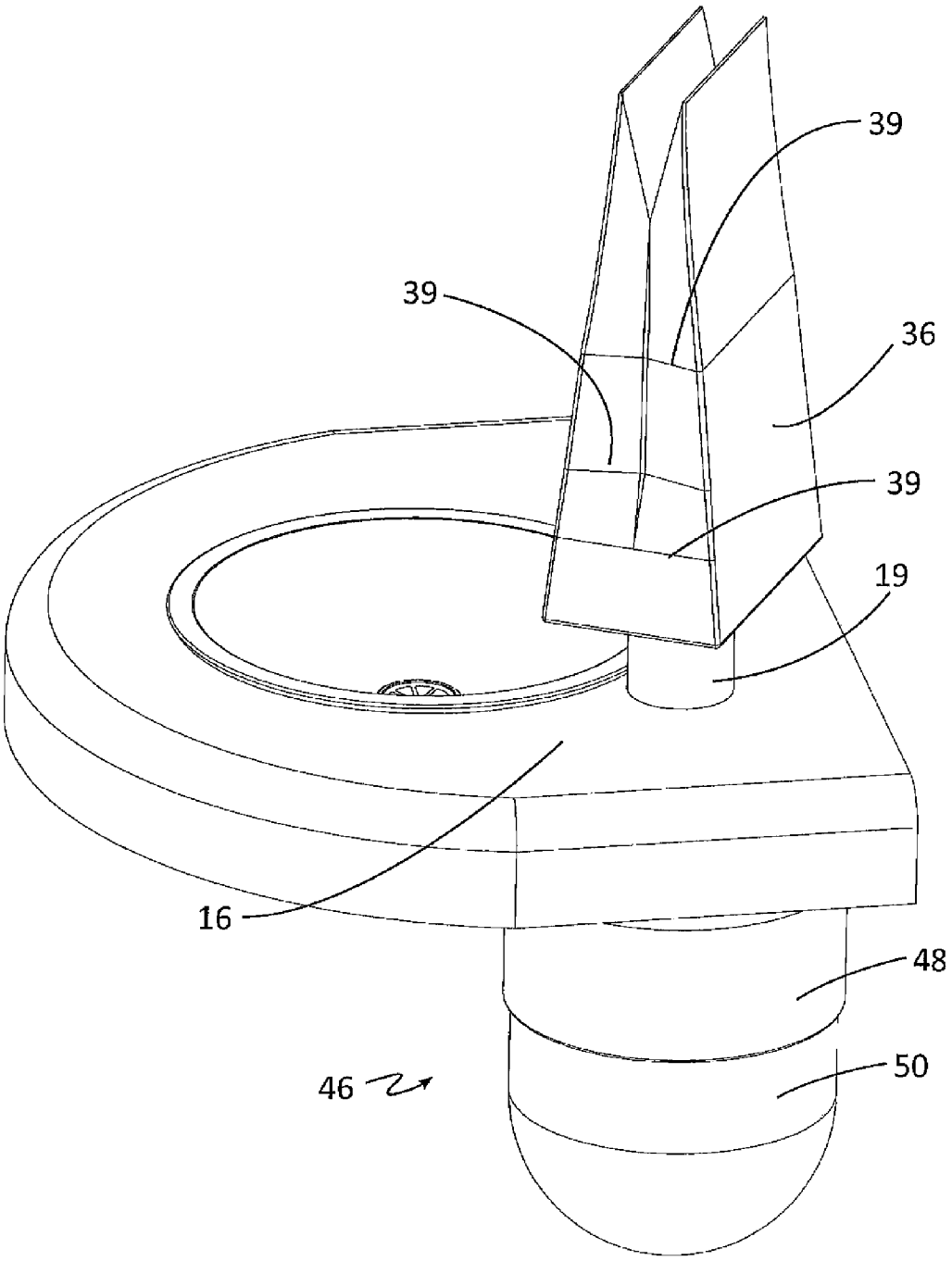
FIG. 21 is a perspective view similar to that shown in FIG. 20 but showing the shipping container partially collapsed.
Figure 22:
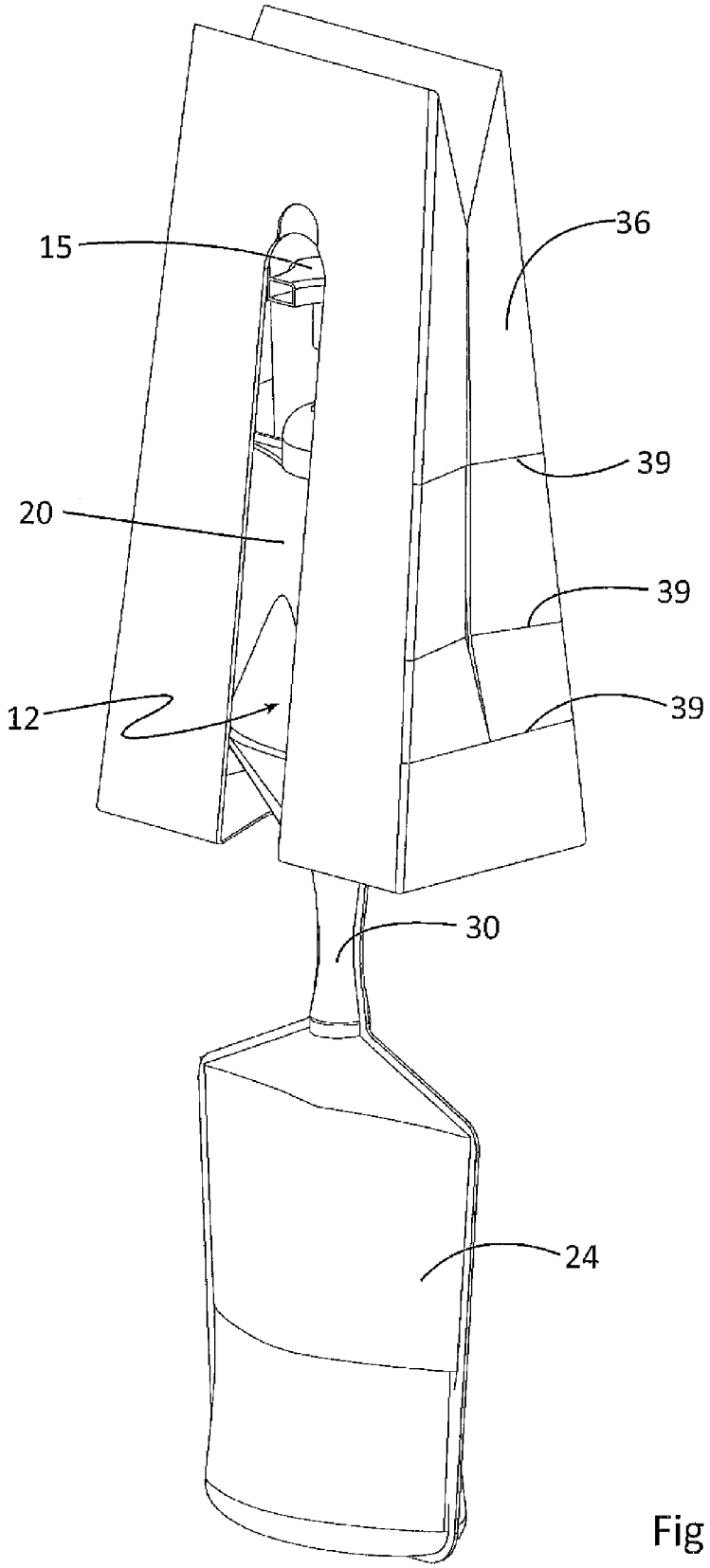
FIG. 22 is a perspective view similar to that shown in FIG. 21 but without the counter and showing the second deformable portion partially filled with liquid.
Figure 23:
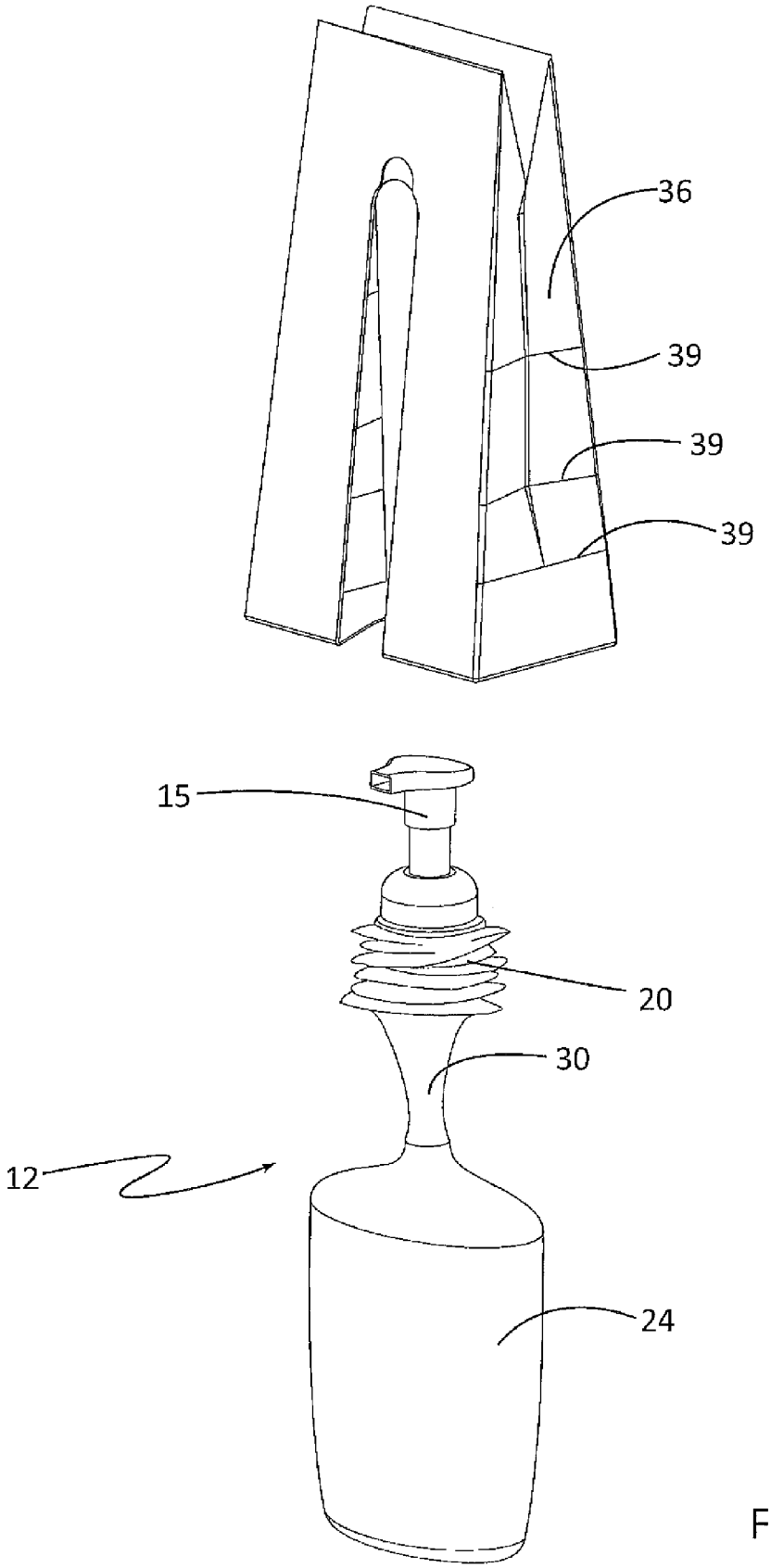
FIG. 23 is a perspective view similar to that shown in FIG. 22 but showing the shipping container removed therefrom and the first deformable portion as it would be in a counter.
Figure 26:
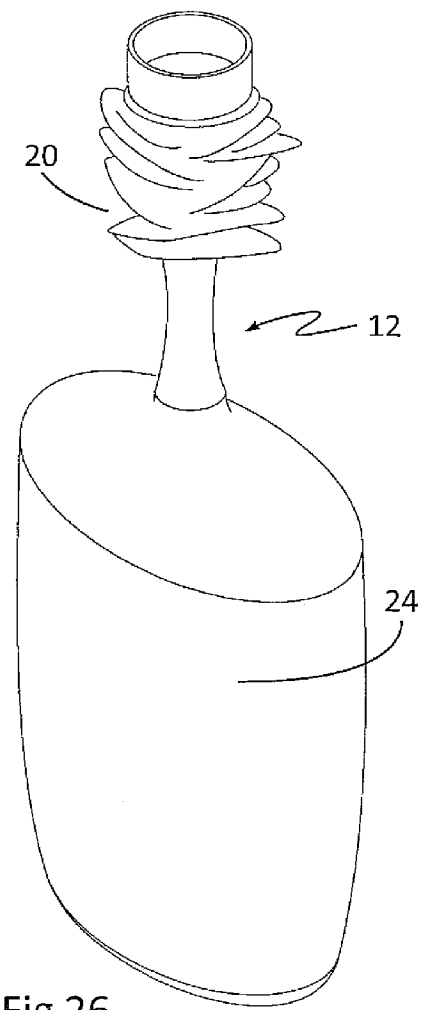
FIG. 26 is perspective view of the liquid container of FIGS. 24 and 25 showing the removable seal removed.
Figure 25:
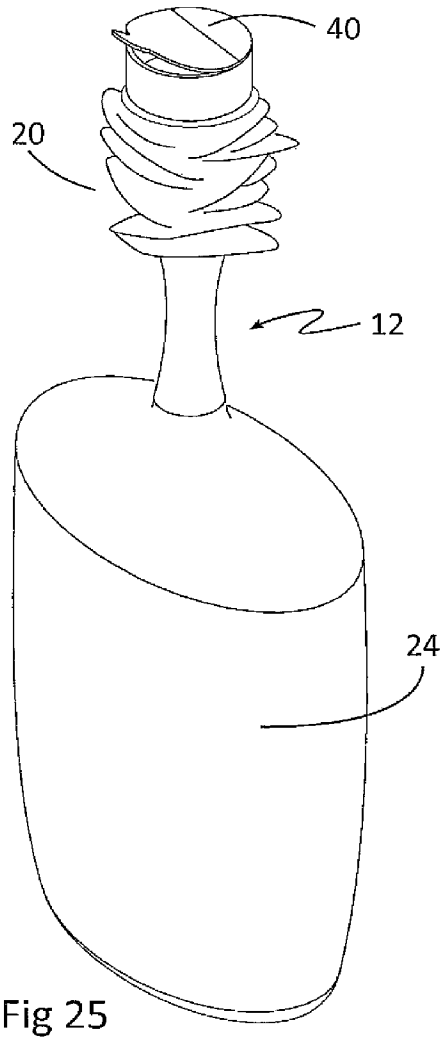
FIG. 25 is perspective view of the liquid container of FIG. 24 showing the removable seal partially removed.

Optionally the deformable container 12 may be housed in a removable box 36, as shown in FIGS. 15 to 23. Box 36 is particularly useful for transporting the container. Box 36 may have a removable portion 38 that is easily removed from the box to provide access to the deformable container 12 inside, such that the seal is removed prior to connecting the pump. Optionally box 36 may include fold lines 39 as shown in FIGS. 21 to 23. Fold lines 39 are used to facilitate a controlled collapsing of the box 36. Box 36 is designed to contain the deformable container 12 that includes a first deformable portion 20 filled with liquid and a second deformable portion 24 wound into a tube and then folded so that it rests against the first deformable portion 20 as can be seen in FIG. 17. The first deformable portion 20 may have a pump 15 attached to the first cavity inlet 28 as can be seen in FIG. 22.

It will be appreciated by those skilled in the art that, by shipping a container 12 with a pump sealed thereto, the liquid is shipped to the end user in a hygienic fashion and it minimizes the opportunity to contaminate the liquid from the manufacturer to the user. In addition, box 36 can provide further protection for the container 12 during shipping.

Figure 24:
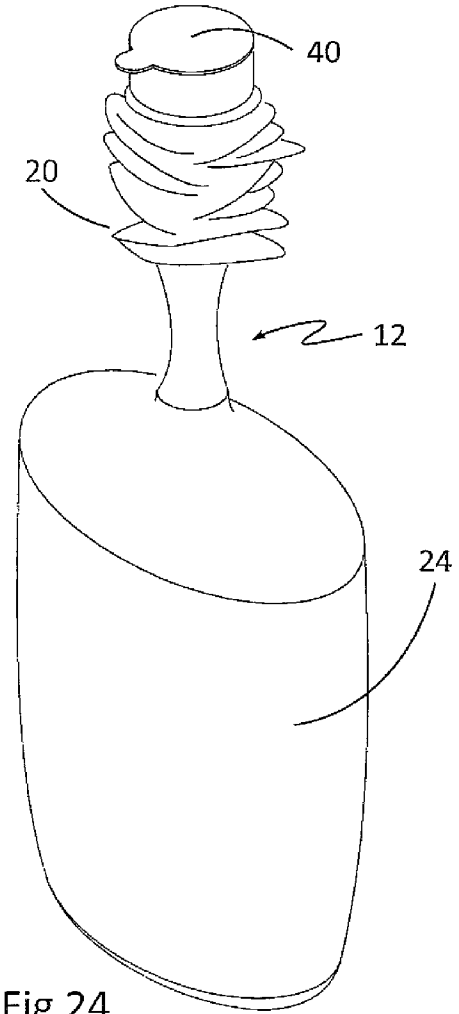
FIG. 24 is a perspective view of an alternate liquid container wherein the inlet to the first cavity is sealed with a removable seal.
Figure 27:
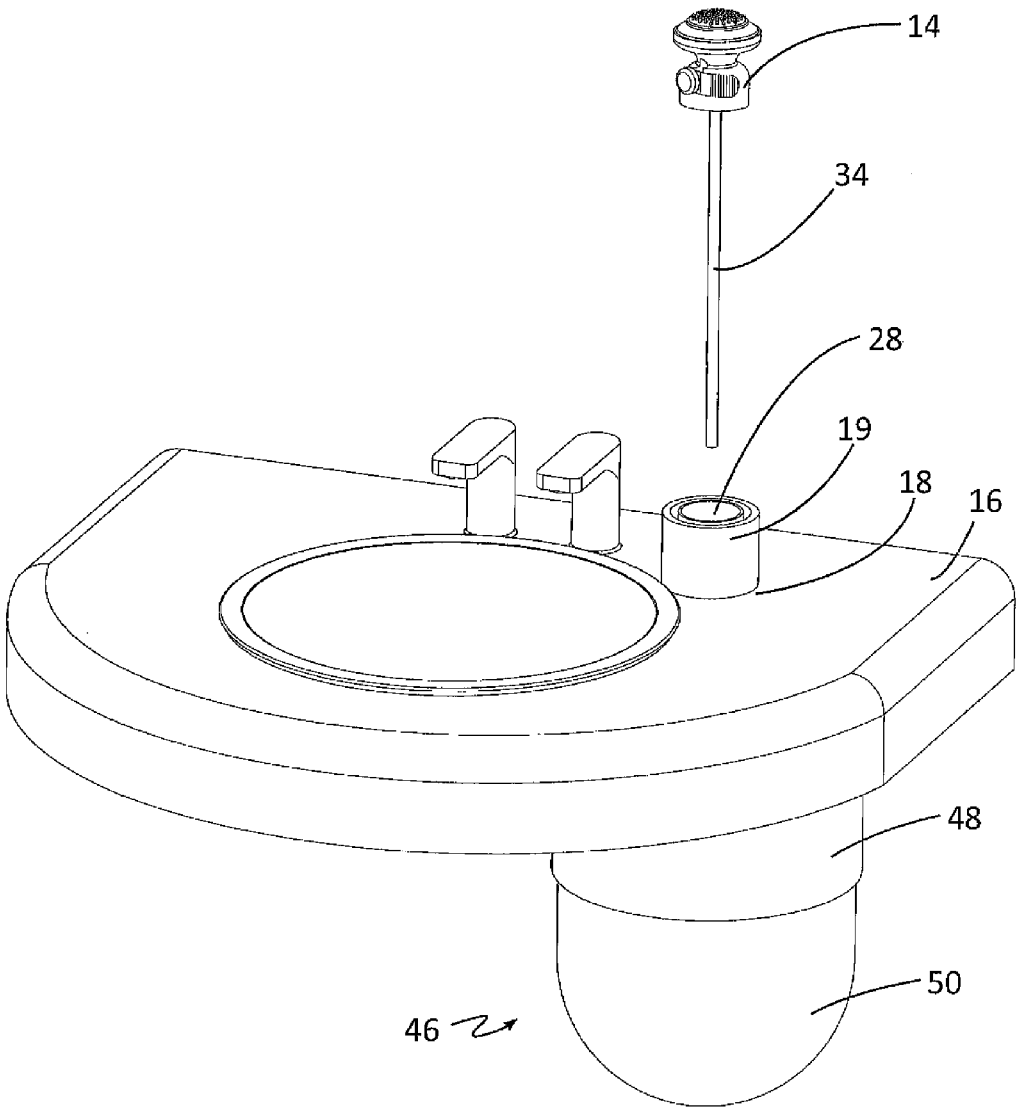
FIG. 27 is perspective view of the liquid container of FIGS. 24 to 26 positioned in a counter, having the removable seal removed and showing a pump and dip tube on the verge of being inserted into the inlet.
Figure 28:
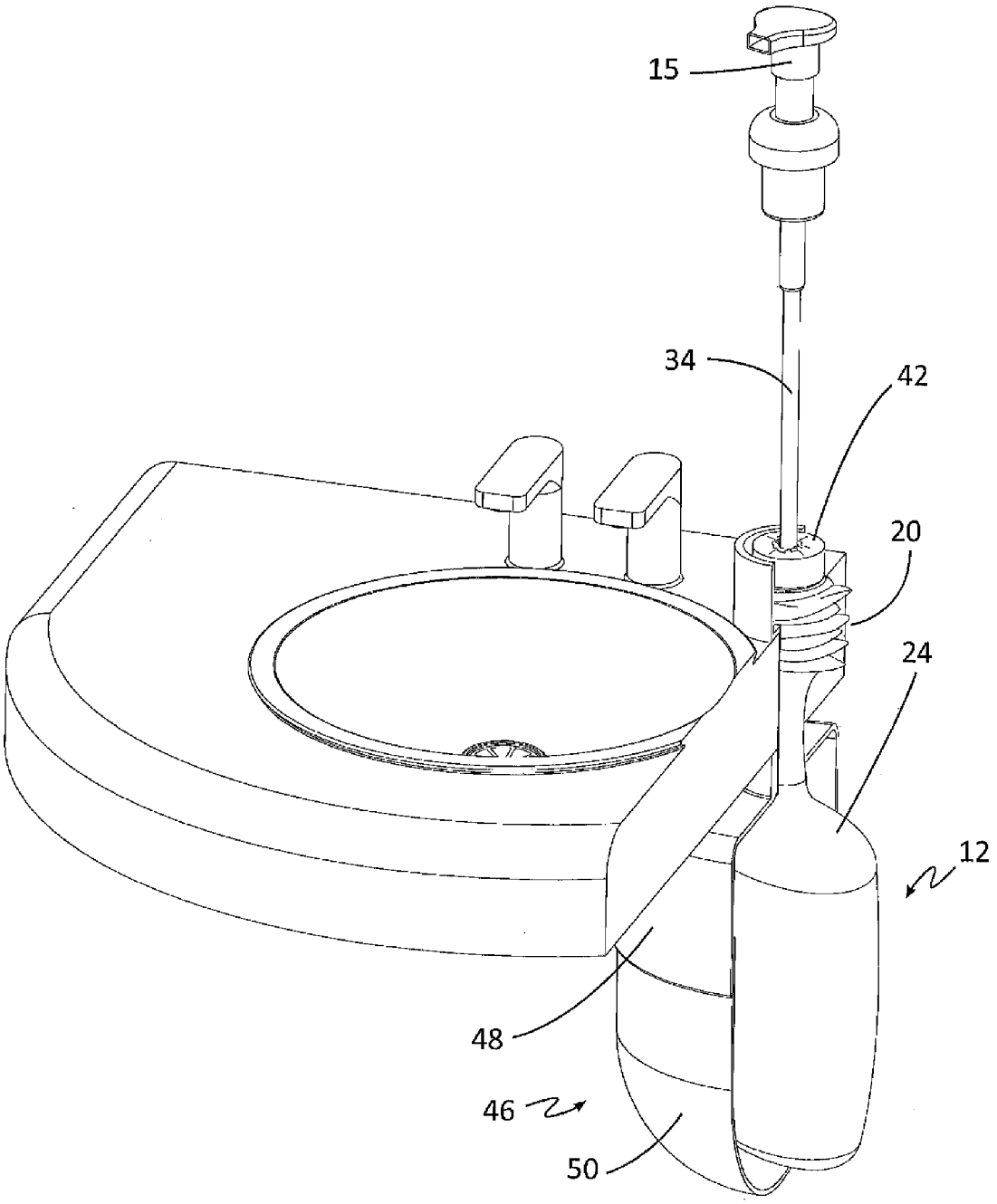
FIG. 28 is a partially broken away perspective view of an alternate liquid container wherein the inlet to the first cavity is sealed with a pierceable seal and showing the seal being pierced by a dip tube.

Optionally the deformable container 12 may include a removable seal 40 as shown in FIGS. 24 and 27. Removable seal 40 is designed to be affixed to the first cavity inlet 28. Removable seal 40 may be removed after the deformable container 12 is positioned in the counter 16. The pump 14 and dip tube 34 assembly is connectable to the sealable first cavity inlet whereby the dip tube extends through the first deformable portion and into the second deformable portion when the first deformable potion has been pushed into the access hole. The pump 14 is then installed in the access hole. Optionally the deformable container 12 may have seal 42 that is adapted to be pierced by pump 14 and dip tube 34 assembly whereby the dip tube is insertable through the seal as shown in FIG. 28.

Figure 29:
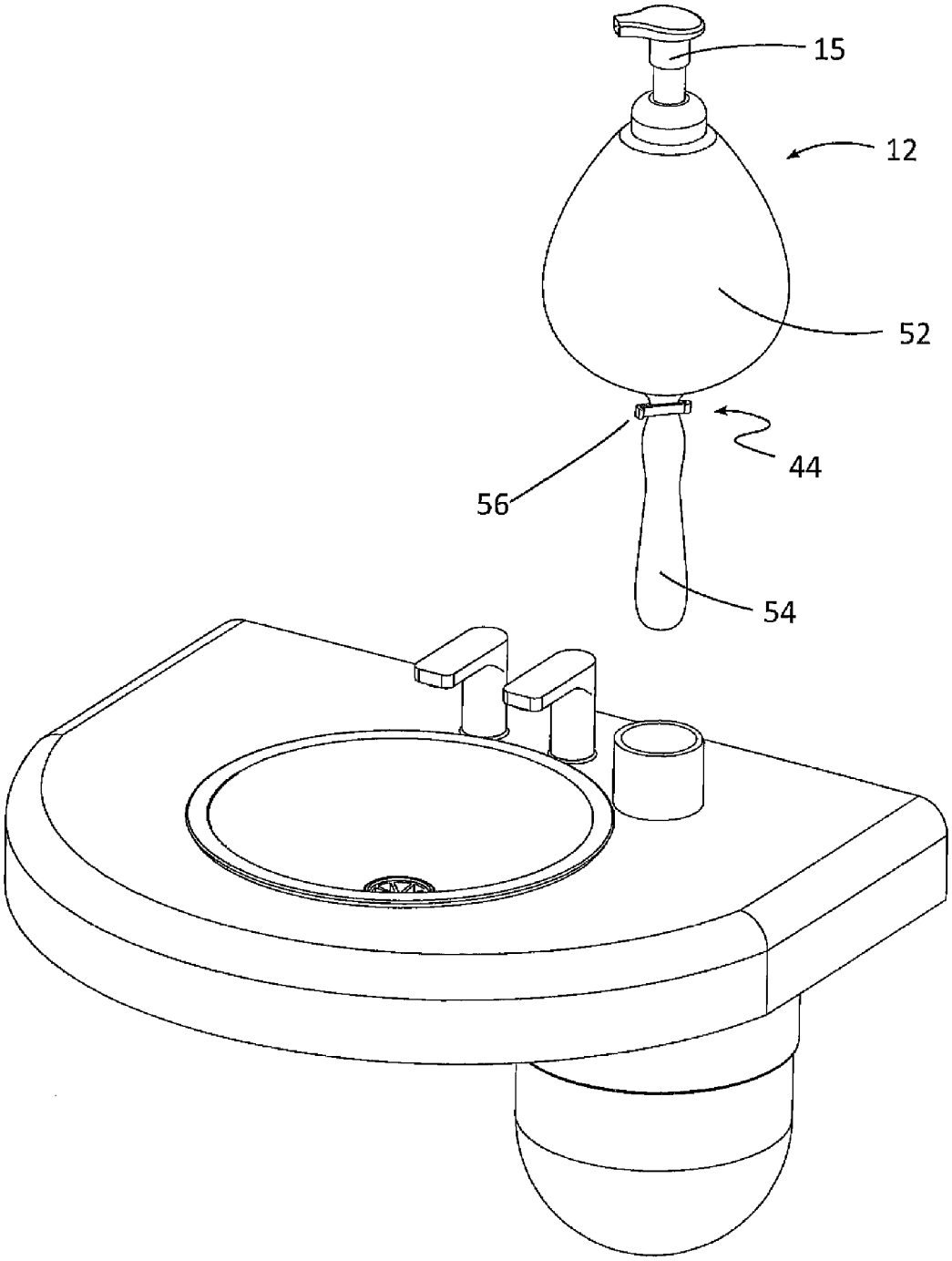
FIG. 29 is a perspective view of another alternate liquid container similar to that shown in FIG. 2 but being made of resiliently deformable material.
Figure 30:
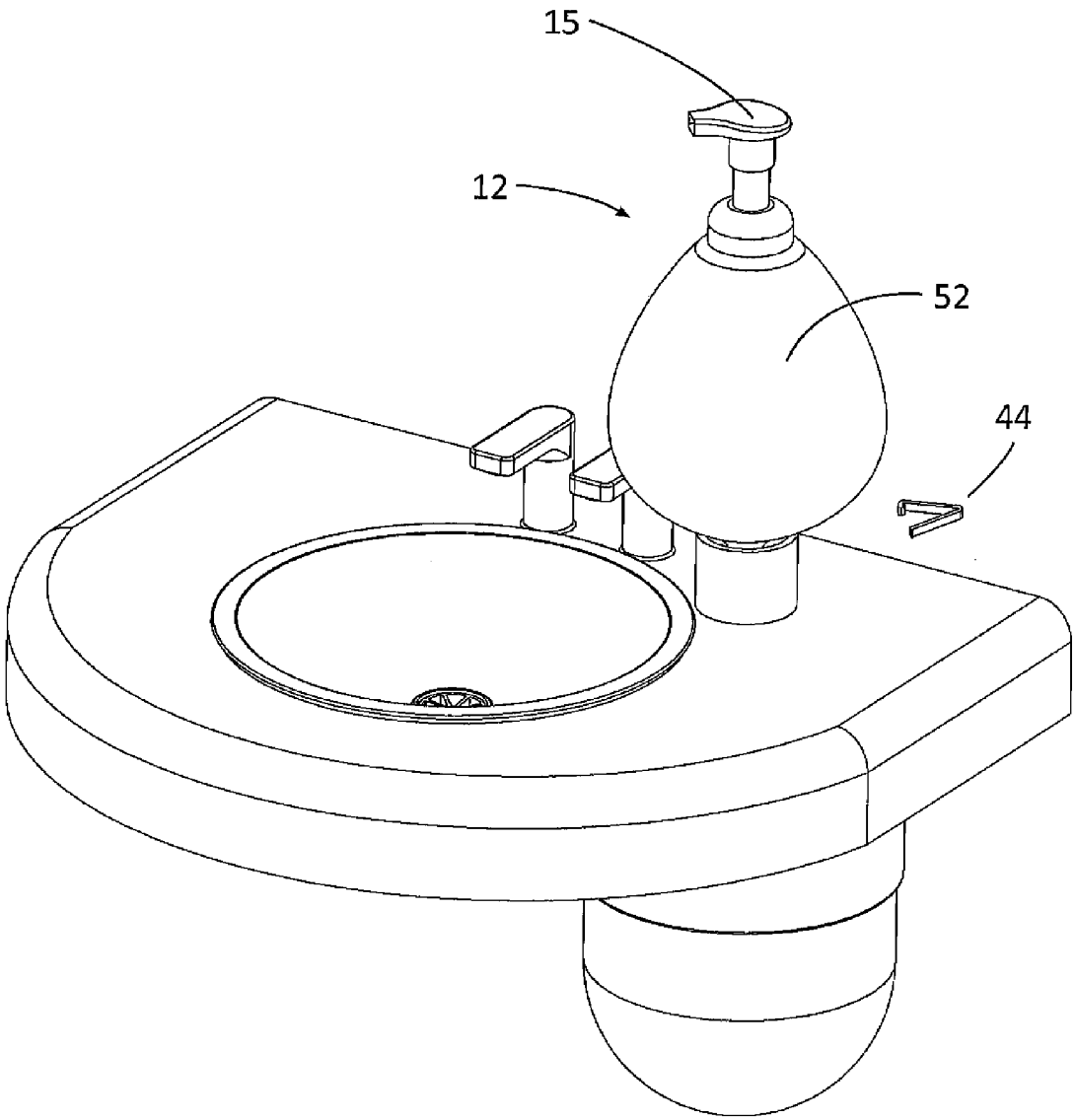
FIG. 30 is a perspective view of the liquid container of FIG. 29 showing the liquid container with a second deformable portion of the container through the aperture formed in the counter and a first deformable portion above the counter.
Figure 31:
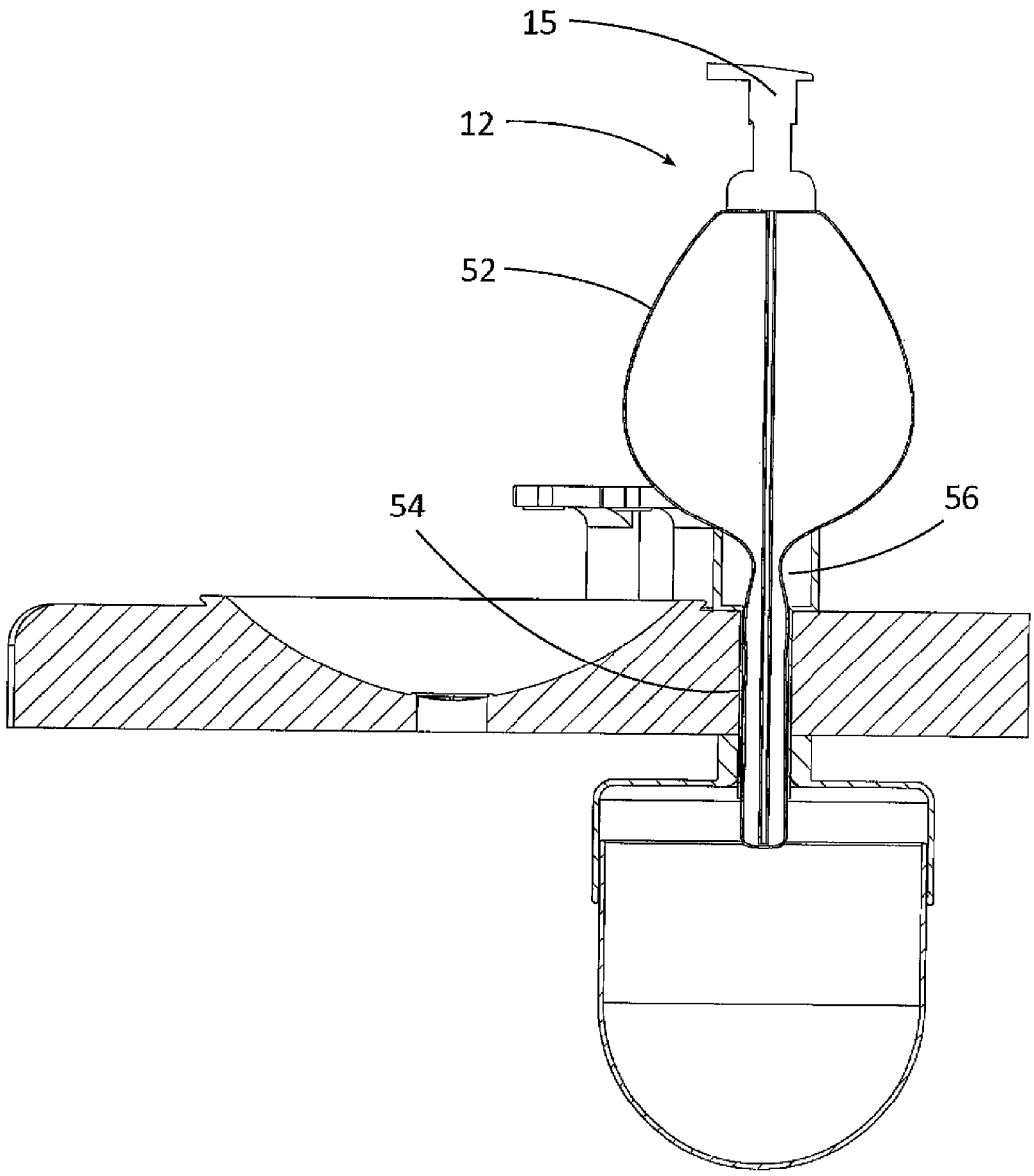
FIG. 31 is a cross sectional view of the liquid container of FIG. 30.
Figure 32:
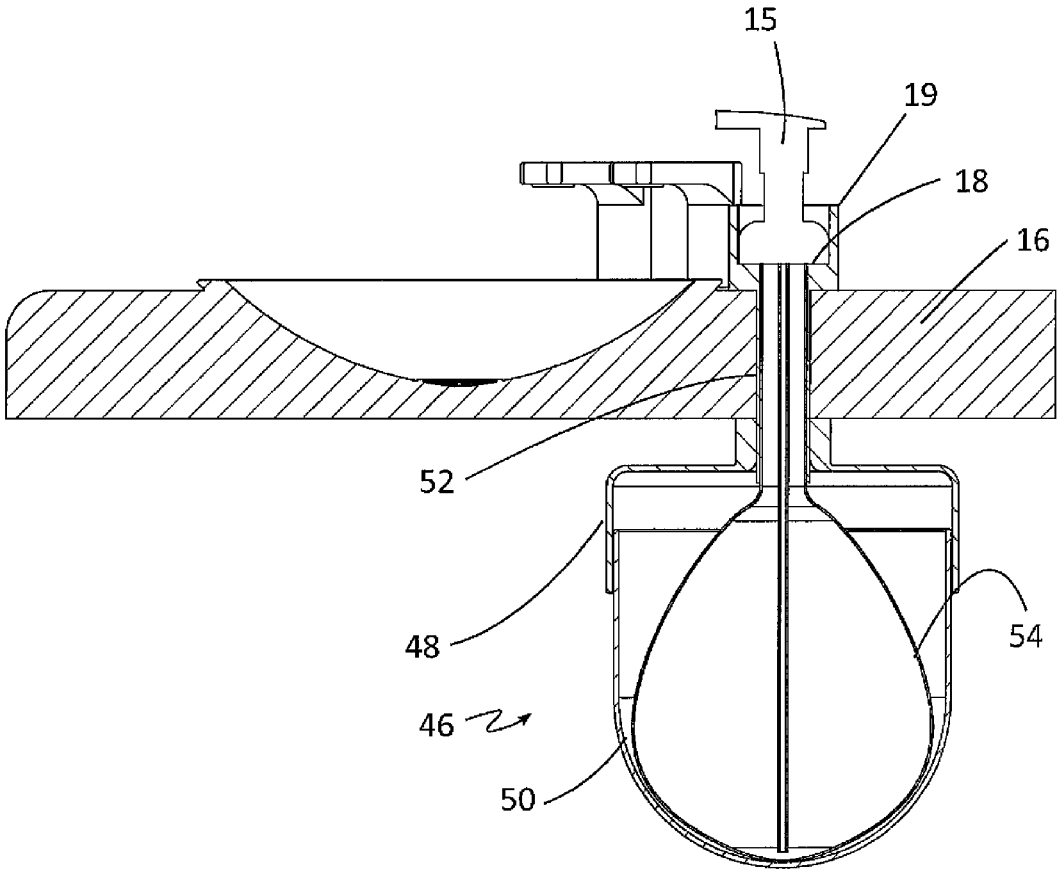
FIG. 32 is a cross sectional view of the liquid container of FIGS. 29 to 31 showing liquid container fully interested in the aperture and the liquid in the second deformable portion.
Figure 33:
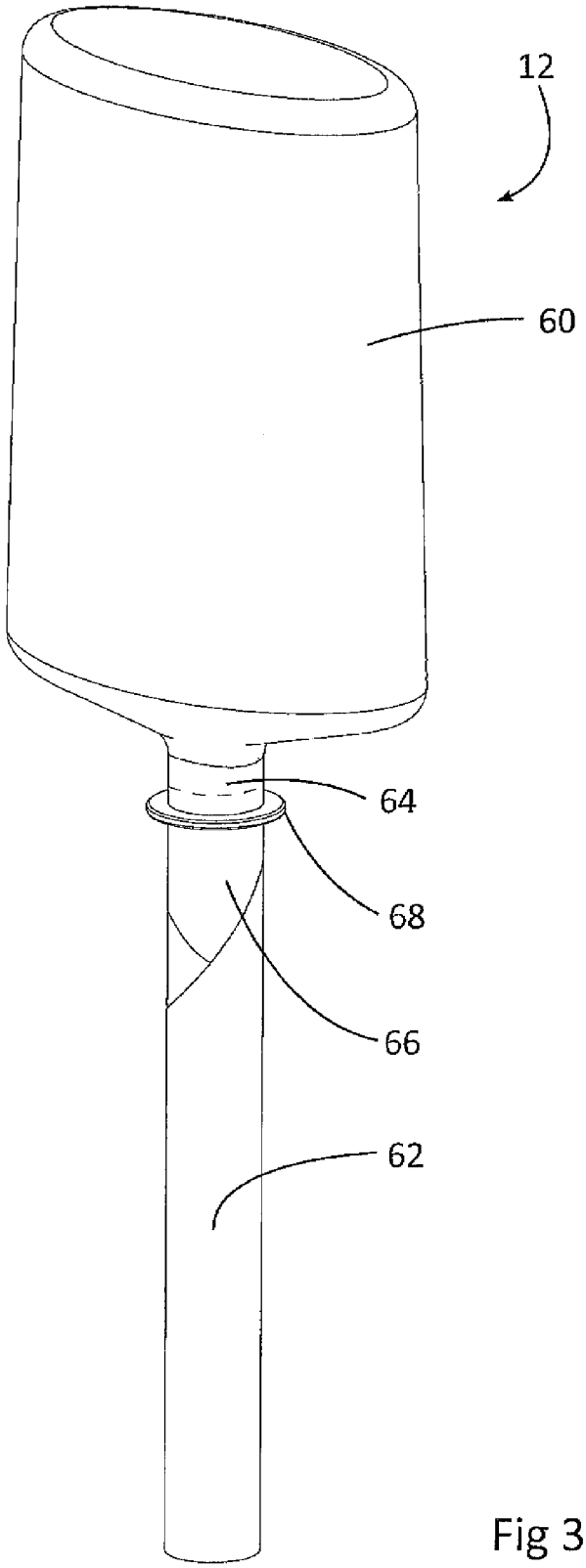
FIG. 33 is a perspective view of another alternate embodiment of the liquid container wherein the first deformable portion is detachable from the second deformable portion and showing the second deformable container wound into a tube.
Figure 34:
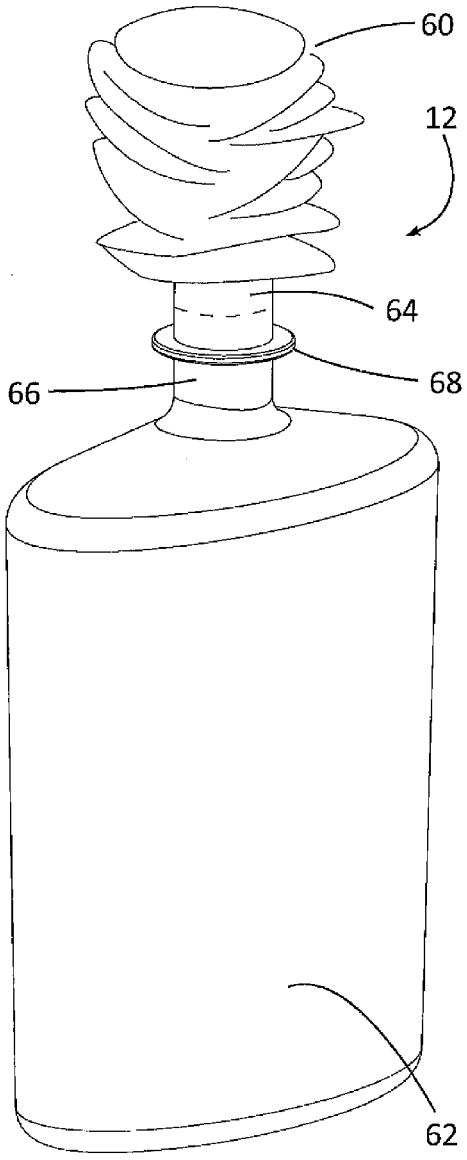
FIG. 34 is a perspective view of the liquid container of FIG. 33 and showing the liquid in the second deformable liquid container and the first deformable liquid container collapsed.

Optionally a removable clip 44 may be included as shown in FIGS. 29 and 30. The clip 44 is configured to engage the neck portion 30 and to inhibit flow from the first cavity to the second cavity when the clip 44 is engaged on the neck portion 30. The container mounted dispenser system 10 may also include a cage 46 below the counter 16 to contain the deformable container 12 once it is positioned in the access hole 18 in the counter. The cage 46 may include an upper portion 48 attached to the underside of the counter and a lower portion 50 removably attachable to the upper portion 48.

Figure 35:
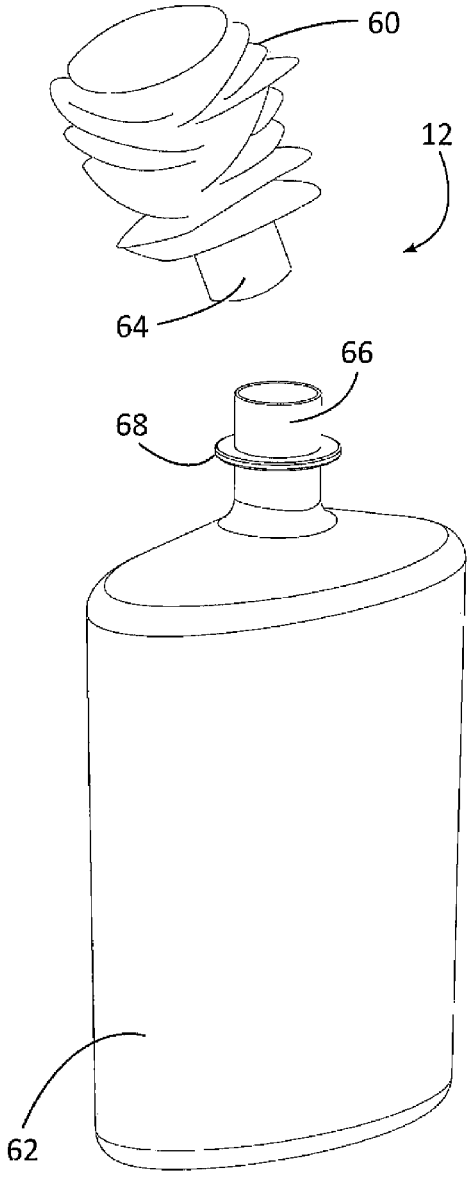
FIG. 35 is a perspective view of the liquid container of FIGS. 33 and 34 wherein the first liquid container is attachable to the second liquid container with a detachable neck joint but showing the first deformable liquid container removed from the second deformable liquid container.
Figure 36:
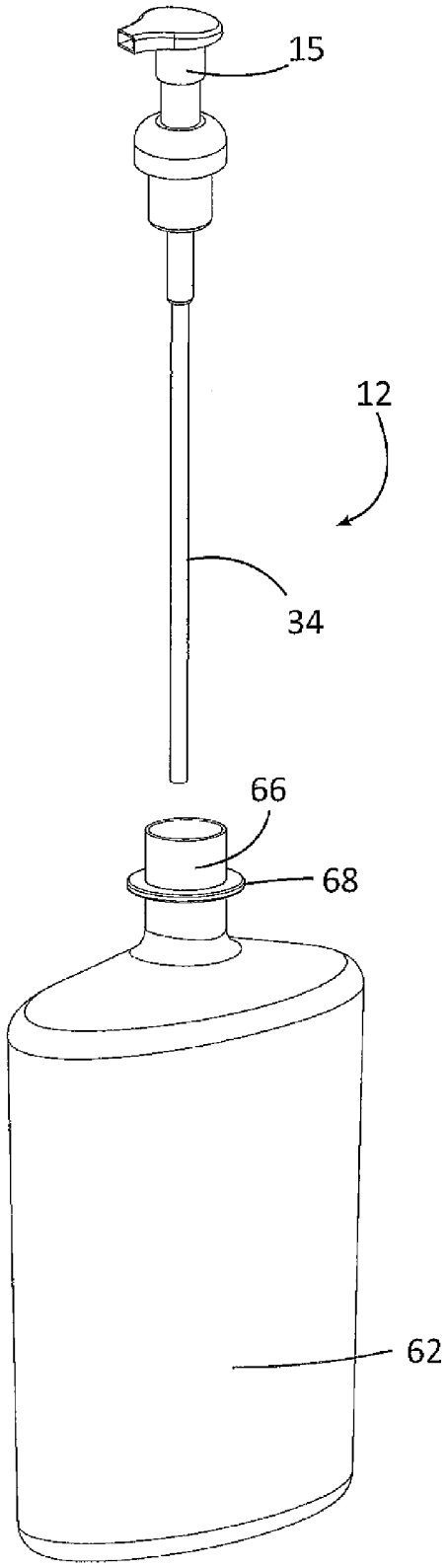
FIG. 36 is a perspective view of the liquid container of FIG. 35 and showing a pump and dip tube on the verge of being positioned in the second deformable container.
Figure 37:
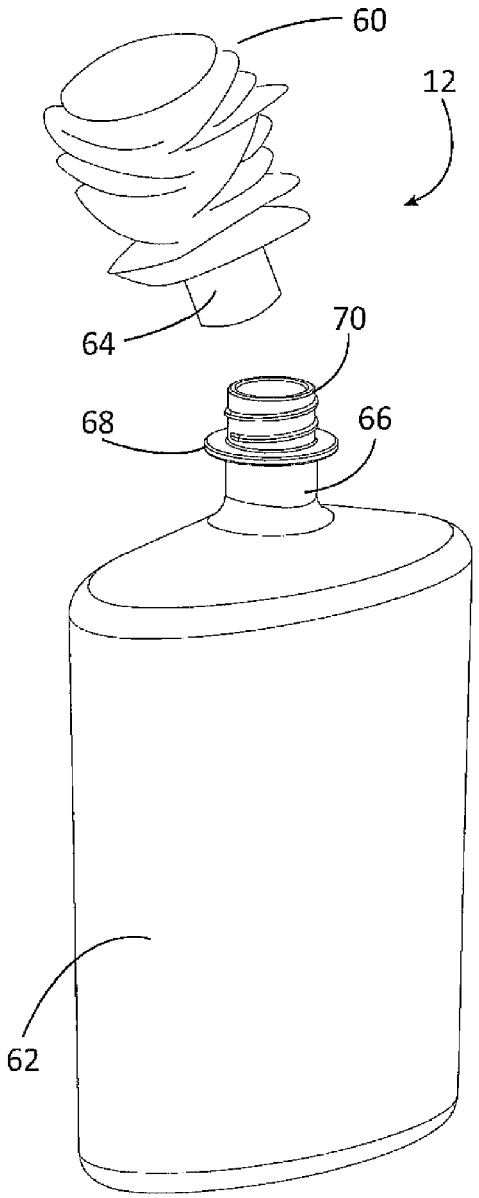
FIG. 37 is a perspective view of the liquid container similar to that shown in FIGS. 33 and 34 wherein the first liquid container is attachable to the second liquid container with threaded attachment but showing the first deformable liquid container removed from the second deformable liquid container.
Figure 38:
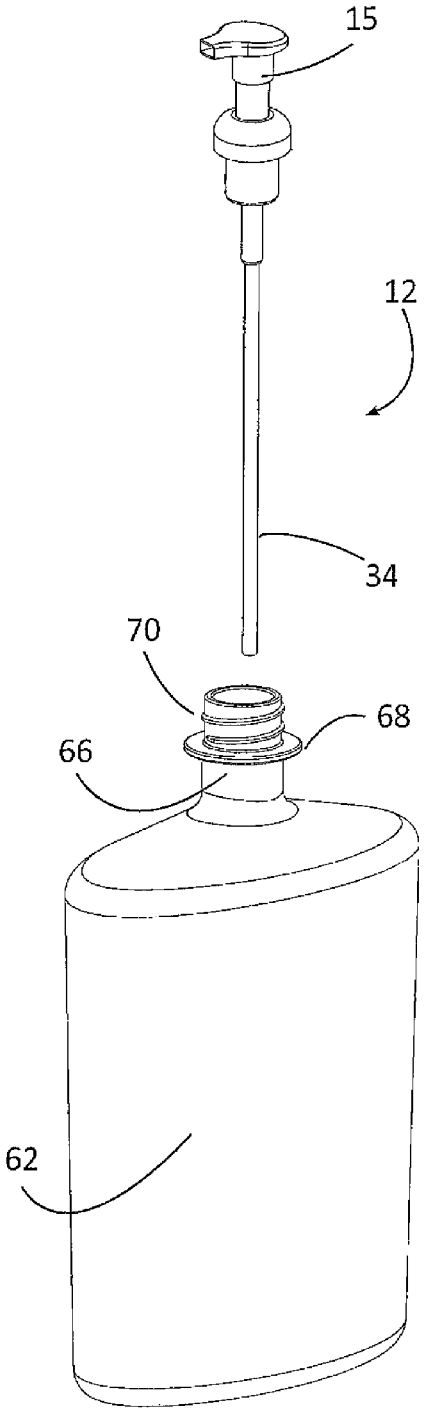
FIG. 38 is a perspective view of the liquid container of FIG. 37 and showing a pump and dip tube on the verge of being positioned in the second deformable container.

Referring to FIGS. 33 to 38, container 12 may be configured such that first portion 60 may be detachable from second deformable portion 62. In this configuration first portion 60 includes a first neck portion 64 and second deformable portion includes a second neck portion 66. Second neck portion 66 has a collar 68 extending outwardly therefrom and the collar 68 is adapted to rest on the access hole 18 of the counter 16. The first neck portion 64 and the second neck portion 66 are releasably connectable together. By way of example only, the first neck portion 64 is connected to the second neck portion 66, as shown in FIGS. 35 and 36, with a detachable neck joint wherein the neck joint is a perforated neck joint or a press fit neck joint. Alternatively it may have a screw fit neck joint 70 as shown in FIGS. 37 and 38.

Note that in the embodiments shown in FIGS. 33 to 38 the first portion 60 need not be a deformable portion since it is not being pushed through access hole 18 in the counter 16.

The embodiments of the container 12 may be manufactured from a variety of different materials. The container 12 may be made from a deformable material. By way of example only the first and second deformable portions may be manufactured from BOPP (biaxially oriented polypropylene), BON (biaxially oriented nylon), CA (cellulose acetate), CTFE (chlorotrifluoroethylene), EAA (ethylene acrylic acid), EEA (ethylene-ethyl acrylate), EMA (ethylene-methyl acrylate), EVA (ethylene-vinyl acetate), EVOH (ethylene-vinyl alcohol), HIPS (high impact polystyrene), LDPE (low-density polyethylene), LLDPE (linear low-density polyethylene), mPE (metallocene polyethylene) OPP (oriented polypropylene), PA (polyamide), PAN (polyacrylonitrile), PB (polybutylene), PE (polyethylene), PET (poly(ethylene terephthalate)), PETG (poly(ethylene terephthalate) glycol), PLA (poly(lactic acid)), PP (polypropylene), PS (polystyrene), PTFE (polytetrafluoroethylene), PUR (polyurethane), PVC (poly(vinyl chloride)), and PVDC (poly(vinylidene chloride)).

Figure 11:
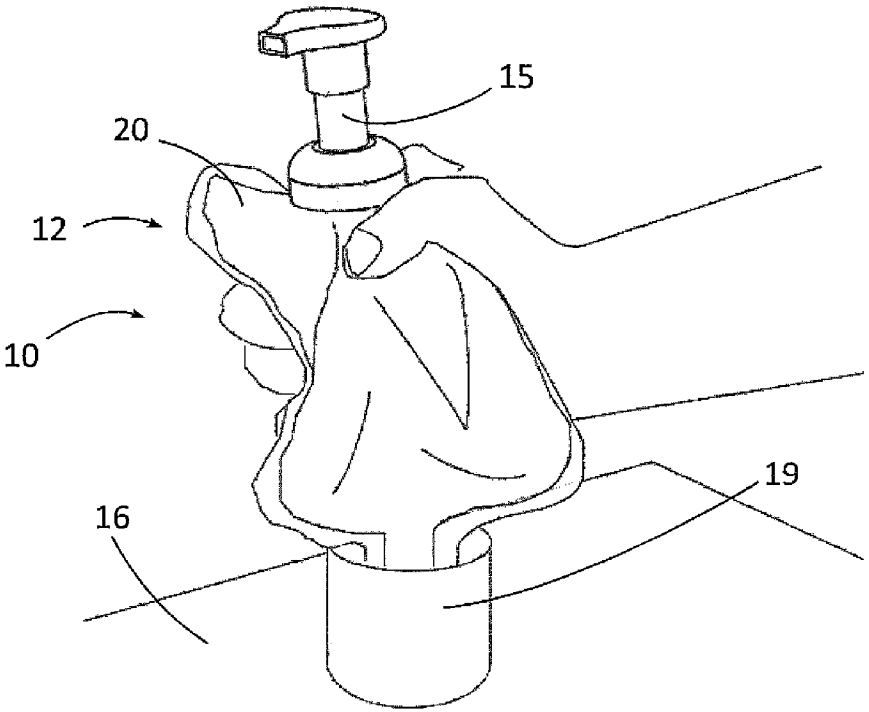
FIG. 11 is a perspective view similar to that shown in FIG. 10 but showing less liquid in the first cavity.
Figure 10:
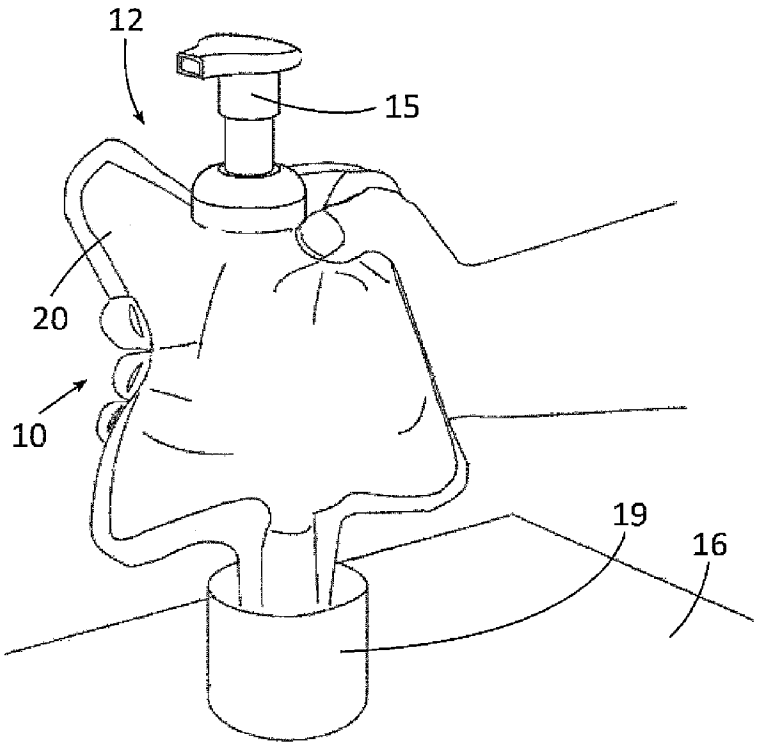
FIG. 10 is a perspective view of the container similar to that shown in FIGS. 2 to 9 but showing an alternate pump and showing a portion of the container through the aperture formed in the counter and a portion above the counter and showing a user urging the liquid from the first cavity into the second cavity formed in the first and second portions, respectively, of the container.
Figure 13:
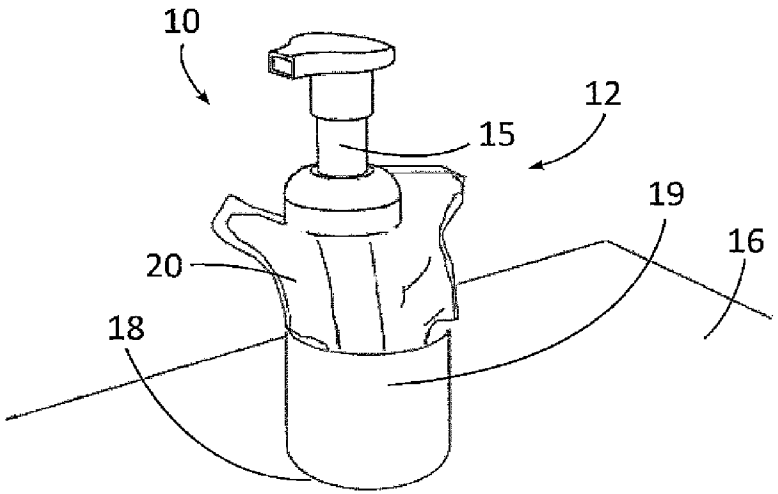
FIG. 13 is a perspective view similar to that shown in FIG. 12 but showing the first cavity being stuffed into the aperture in the counter.
Figure 12:
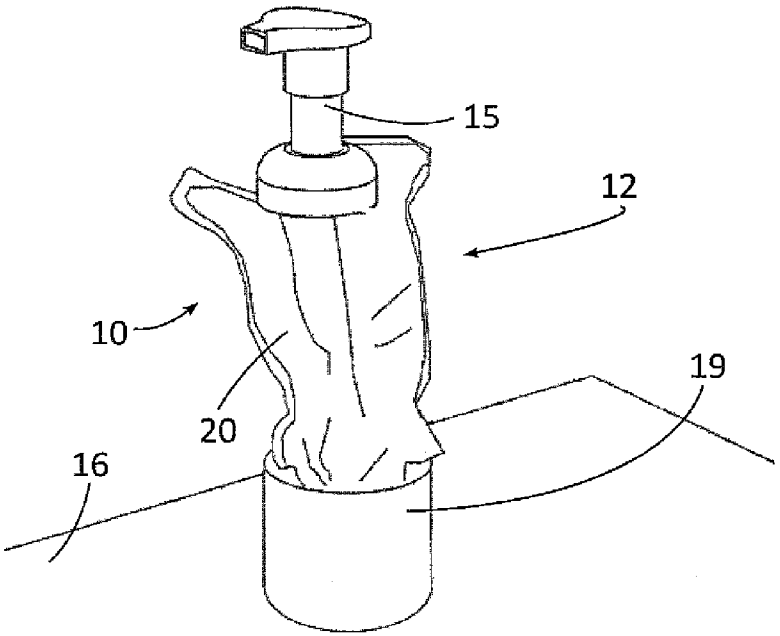
FIG. 12 is a perspective view similar to that shown in FIG. 11 but showing even less liquid in the first cavity.
Figure 14:
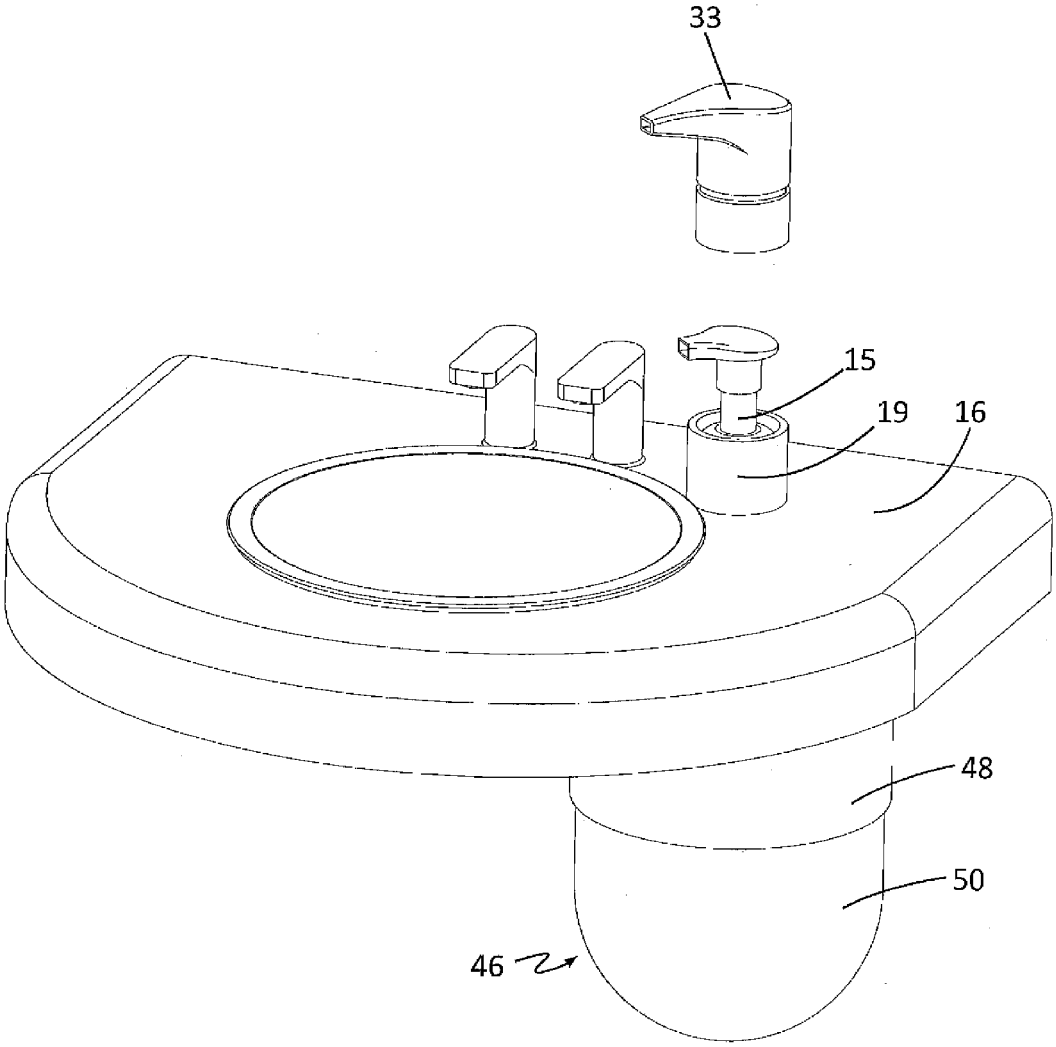
FIG. 14 is a perspective view of the container and pump of FIGS. 10 to 13 installed in the aperture formed in the counter and further showing an alternate embodiment of an optional dispenser being positioned over the pump.
Figure 16:
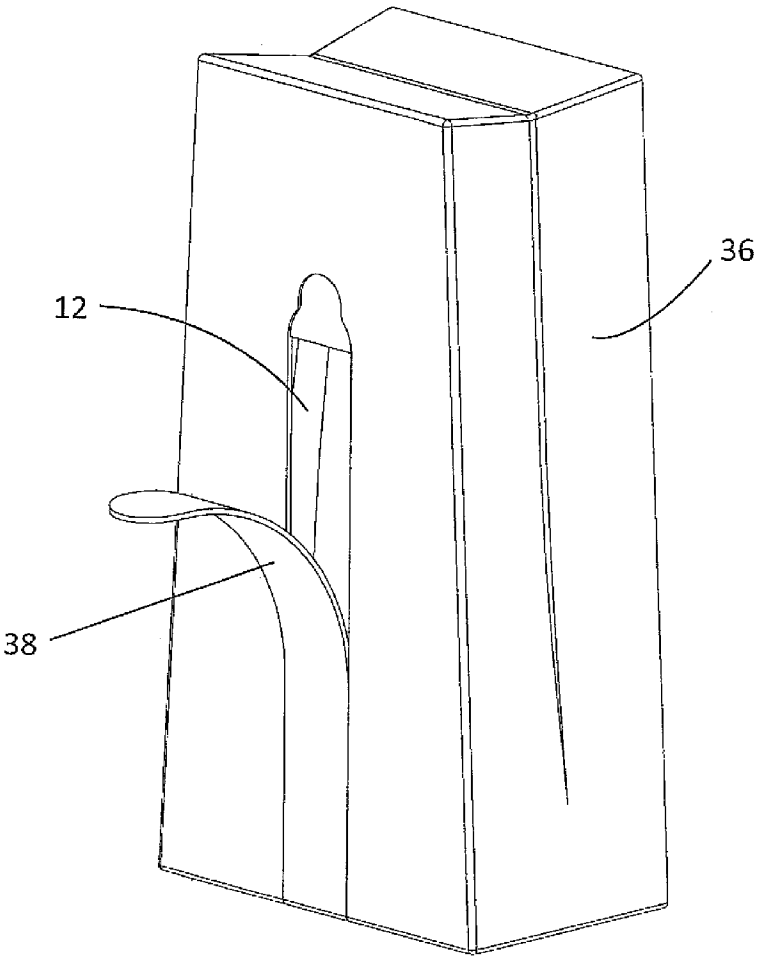
FIG. 16 is a perspective view of the shipping container shown in FIG. 15 and showing removable portion partially removed.
Figure 15:
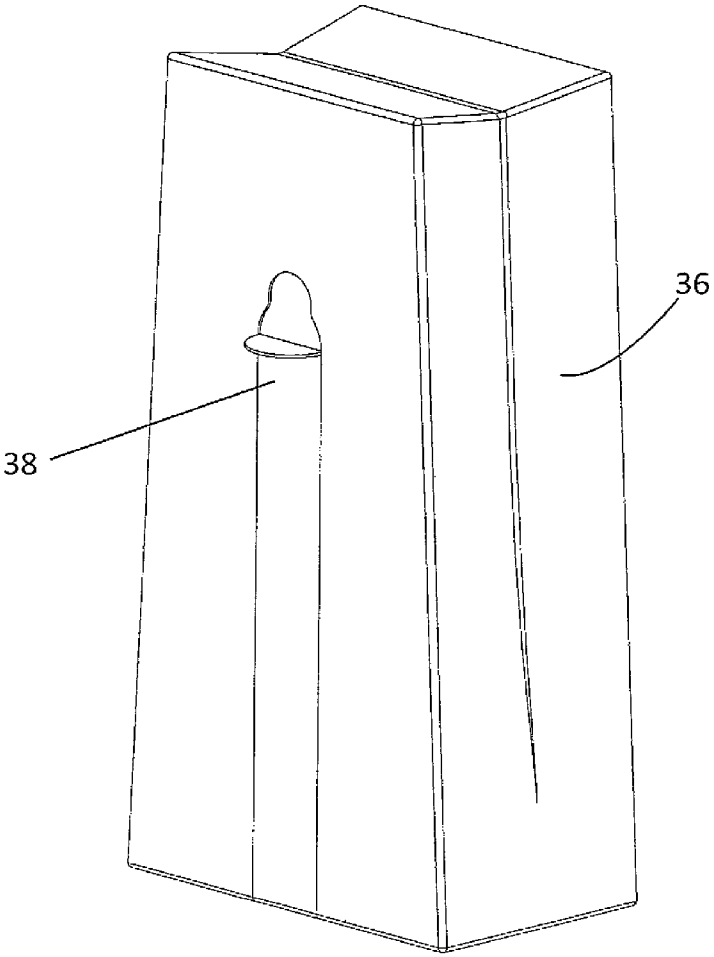
FIG. 15 is a perspective view of a shipping container for use with a liquid container examples of which are shown in the earlier figures.
Figure 18:
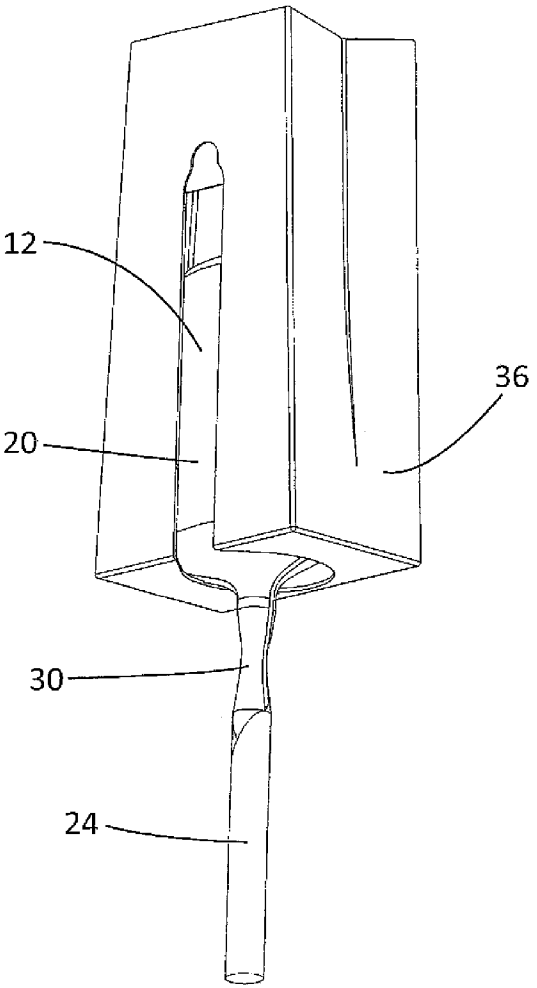
FIG. 18 is a perspective view similar to that shown in FIG. 17 but showing the second deformable portion wound into a tube and extending downwardly from the shipping container.

Alternatively the container may be made from a resiliently deformable material as shown in FIGS. 29 to 32. When the container 12 is made from a resiliently deformable material the first deformable portion, neck and second deformable may appear to be one long balloon like structure and it is when the container is in use that the first deformable portion 52 and second deformable portion 54 are defined. The neck 56 is defined by the clip 44. By way of example only, the first and second deformable portions may be manufactured from latex, silicone rubber, polyisoprene and mylar, In use the different embodiments of the container 12 are designed to facilitate providing or installing a liquid container at a location under the counter for use with a pump that is attached to the counter 16. In use, the second deformable portion 24 of the container 12 is inserted or fed through the access hole 18 in the counter 16. Once the second deformable portion 24 is fully inserted into the hole, the clip 44, if present, is removed. Thereafter, pressure is exerted on the first deformable portion 20 such that the liquid in the first cavity is urged from the first cavity and starts to flow into the second cavity. Pressure may be exerted by hand as shown in FIGS. 10 and 11 or by way of a controlled collapse which may be achieved with the box 36. Once the liquid has been transferred into the second cavity the pump is positioned in the access hole 18. In some embodiments the pump is attached to the first deformable portion prior to shipping as shown in FIGS. 1 to 23 and 29 to 32. Alternatively where the container includes a removable seal 40, the seal is removed and the pump and dip tube assembly is positioned in the access hole as shown in FIGS. 24 to 27. As another alternative where the seal is a piercable seal 42 the dip tube pierces the seal 42 and the pump and dip tube assembly are positioned in the access hole 18. A further alternative is shown in FIGS. 33 to 38 wherein the second deformable container potion 62 includes a collar 68 which rests on the access hole 18 and the first deformable container portion 60 is detachable from the second deformable portion 62. The container 12 may include a detachable neck joint 66 wherein the neck joint is a perforated neck joint or a press fit neck joint as shown in FIGS. 35 and 36. Alternatively the neck joint may be a threaded neck joint 70 as shown in FIGS. 37 and 38. Thereafter the pump and dip tube assembly are positioned in the access hole 18. Optionally a dispenser 32 or 33 may then be positioned over or attached to the pump 14 or 15 and the dispenser is adapted to engage the pump such that activation of the dispenser engages the pump 14 or 15 and causes liquid to be drawn up the dip tube 34 into the pump 14, 15 and dispensed through the dispenser 32 or 33. It will be appreciated by those skilled in the art that the dispenser may be a hand activated dispenser or the dispenser may include a motion sensor to automatically activate the dispenser.

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately" are meant to cover variations that may exist in the upper and lower limits of the ranges of values, such as variations in properties, parameters, and dimensions. In one non-limiting example, the terms "about" and "approximately" mean plus or minus 10 percent or less.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

Unless defined otherwise, all technical and scientific terms used herein are intended to have the same meaning as commonly understood to one of ordinary skill in the art.

What is claimed is:

1. A container for flowable material configured to be installed in a counter below an access hole, the container comprising;

a first deformable portion defining a first cavity, having flowable material therein and having a sealable first cavity inlet and the first cavity inlet being sealed, wherein the sealable first cavity inlet is sealed with a pump;

a second deformable portion defining a second cavity in flow communication with the first cavity;

the second deformable portion configured to deform to fit through the access hole when substantially no flowable material is therein; and the first deformable portion configured to deform to fit into the access hole when substantially all of the flowable material has been urged into the second deformable portion.

2. The container as claimed in claim 1 further including a neck portion between the first deformable portion and the second deformable portion.

3. The container as claimed in claim 2 further including a removable clip configured to engage the neck portion and to inhibit flow from the first cavity to the second cavity when engaged on the neck portion.

4. The container as claimed in claim 1 wherein the pump includes a dip tube.

5. The container as claimed in claim 1 wherein the pump is configured to be engaged by a dispenser.

6. The container as claimed in claim 1 further including a box for transporting the container.

7. The container as claimed in claim 6 wherein the box includes a removable portion.

8. The container as claimed in claim 1 wherein the second deformable portion is wound into a tube.

9. The container as claimed in claim 8 wherein the tube is folded so that the tube rests against the first deformable portion.

10. The container as claimed in claim 1 wherein the first deformable portion and the second deformable portion are resiliently deformable.

11. The container as claimed in claim 1 wherein the first deformable portion and the second deformable portion are manufactured from one of BOPP (biaxially oriented polypropylene), BON (biaxially oriented nylon), CA (cellulose acetate), CTFE (chlorotrifluoroethylene), EAA (ethylene acrylic acid), EEA (ethylene-ethyl acrylate), EMA (ethylene-methyl acrylate), EVA (ethylene-vinyl acetate), EVOH (ethylene-vinyl alcohol), HIPS (high impact polystyrene), LDPE (low-density polyethylene), LLDPE (linear low-density polyethylene), mPE (metallocene polyethylene) OPP (oriented polypropylene), PA (polyamide), PAN (polyacrylonitrile), PB (polybutylene), PE (polyethylene), PET (poly(ethylene terephthalate)), PETG (poly(ethylene terephthalate) glycol), PLA (poly(lactic acid)), PP (polypropylene), PS (polystyrene), PTFE (polytetrafluoroethylene), PUR (polyurethane), PVC (poly(vinyl chloride)), and PVDC (poly(vinylidene chloride)).

12. The container as claimed in claim 1 wherein the first deformable portion and the second deformable portion are manufactured from one of latex, silicone rubber, polyisoprene and mylar.

13. The container as claimed in claim 1 further including a cage which is configured to be attached to the counter below the access hole.

14. The container as claimed in claim 13 wherein the cage configured to be attached to the counter includes a lower portion removably attached to an upper portion.

15. A method of installing a container of flowable material in a counter below an access hole, the container having a first deformable portion in flow communication with a second deformable portion, said first deformable portion defining a first cavity, having flowable material therein and having a sealable first cavity inlet and the first cavity inlet being sealed, wherein the sealable first cavity inlet is sealed with a pump, the method comprising the steps of:

feeding the second deformable portion having substantially no flowable material therein through the access hole;

urging the flowable material in the first deformable portion into the second deformable portion; and feeding the first deformable portion having substantially no flowable material therein into the access hole such that the pump sealing the first cavity inlet is positioned in the access hole, and the pump is in flow communication with the container.

16. The method as claimed in claim 15 further including the step of attaching a dispenser to the pump.

17. The method as claimed in claim 15 wherein the container further includes a box and the box includes a removable portion, and the method further including the steps of removing the removable portion of the box; removing the first deformable portion from the box; squeezing the box to urge the flowable material in the first deformable portion into the second deformable portion; and removing the box.

18. A container for flowable material configured to be installed in a counter below an access hole, the container comprising;

a first deformable portion defining a first cavity, having flowable material therein and having a sealable first cavity inlet and the first cavity inlet being sealed;

a second deformable portion defining a second cavity in flow communication with the first cavity;

a neck portion between the first deformable portion and the second deformable portion; and a removable clip configured to engage the neck portion and to inhibit flow from the first cavity to the second cavity when engaged on the neck portion;

the second deformable portion configured to deform to fit through the access hole when substantially no flowable material is therein; and the first deformable portion configured to deform to fit into the access hole when substantially all of the flowable material has been urged into the second deformable portion.

19. The container as claimed in claim 18 further including a seal affixed to the sealable first cavity inlet.

20. The container as claimed in claim 19 further including a pump having a dip tube and the pump is connectable to the sealable first cavity inlet whereby the dip tube extends through the first deformable portion into the second deformable portion.

21. The container as claimed in claim 20 wherein the seal is removable prior to connecting the pump.

22. The container as claimed in claim 20 wherein the dip tube is insertable through the seal.

23. The container as claimed in claim 18 further including a box for transporting the container.

24. The container as claimed in claim 23 wherein the box includes a removable portion.

25. The container as claimed in claim 18 wherein the first deformable portion and the second deformable portion are resiliently deformable.

26. The container as claimed in claim 18 wherein the first deformable portion and the second deformable portion are manufactured from one of BOPP (biaxially oriented polypropylene), BON (biaxially oriented nylon), CA (cellulose acetate), CTFE (chlorotrifluoroethylene), EAA (ethylene acrylic acid), EEA (ethylene-ethyl acrylate), EMA (ethylene-methyl acrylate), EVA (ethylene-vinyl acetate), EVOH (ethylene-vinyl alcohol), HIPS (high impact polystyrene), LDPE (low-density polyethylene), LLDPE (linear low-density polyethylene), mPE (metallocene polyethylene) OPP (oriented polypropylene), PA (polyamide), PAN (polyacrylonitrile), PB (polybutylene), PE (polyethylene), PET (poly(ethylene terephthalate)), PETG (poly(ethylene terephthalate) glycol), PLA (poly(lactic acid)), PP (polypropylene), PS (polystyrene), PTFE (polytetrafluoroethylene), PUR (polyurethane), PVC (poly(vinyl chloride)), and PVDC (poly(vinylidene chloride)).

27. The container as claimed in claim 18 wherein the first deformable portion and the second deformable portion are manufactured from one of latex, silicone rubber, polyisoprene and mylar.

28. A container for flowable material configured to be installed in a counter below an access hole, the container comprising;

a first deformable portion defining a first cavity, having flowable material therein and having a sealable first cavity inlet and the first cavity inlet being sealed;

a second deformable portion defining a second cavity in flow communication with the first cavity; and a cage which is configured to be attached to the counter below the access hole;

the second deformable portion configured to deform to fit through the access hole when substantially no flowable material is therein; and the first deformable portion configured to deform to fit into the access hole when substantially all of the flowable material has been urged into the second deformable portion.

29. The container as claimed in claim 28 wherein the cage configured to be attached to the counter includes a lower portion removably attached to an upper portion.

* * * * *